US007907879B2

(12) United States Patent
Yamada et al.

(10) Patent No.: US 7,907,879 B2
(45) Date of Patent: Mar. 15, 2011

(54) DEVELOPMENT ROLLER, DEVELOPMENT DEVICE, IMAGE FORMING APPARATUS, AND METHOD OF MANUFACTURING DEVELOPMENT ROLLER

(75) Inventors: Yoichi Yamada, Shiojiri (JP); Masahiro Maeda, Matsumoto (JP); Junichi Suzuki, Chino (JP); Takatomo Fukumoto, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 84 days.

(21) Appl. No.: 12/388,908

(22) Filed: Feb. 19, 2009

(65) Prior Publication Data

US 2009/0214271 A1 Aug. 27, 2009

(30) Foreign Application Priority Data

Feb. 21, 2008 (JP) ..... 2008-039955
Feb. 21, 2008 (JP) ..... 2008-039956

(51) Int. Cl.
*G03G 15/08* (2006.01)

(52) U.S. Cl. ..... 399/286

(58) Field of Classification Search ..... 399/254, 399/258, 267, 270, 276, 279, 286; 29/895; 492/18, 28, 30
See application file for complete search history.

(56) References Cited

U.S. PATENT DOCUMENTS

| | | | | |
|---|---|---|---|---|
| 4,368,971 | A | 1/1983 | Watanabe et al. | |
| 4,564,285 | A * | 1/1986 | Yasuda et al. | 399/274 |
| 5,062,385 | A * | 11/1991 | Nishio et al. | 399/284 |
| 6,104,903 | A | 8/2000 | Hara et al. | |
| 6,201,942 | B1 | 3/2001 | Honda et al. | |
| 7,565,099 | B2 | 7/2009 | Yamada et al. | |

FOREIGN PATENT DOCUMENTS

| | | | |
|---|---|---|---|
| JP | 11119554 | A | 4/1999 |
| JP | 2000284586 | A | 10/2000 |
| JP | 2006201505 | A | 8/2006 |
| JP | 2007-121948 | | 5/2007 |
| JP | 2007121950 | A | 5/2007 |
| JP | 2007183312 | A | 7/2007 |
| JP | 2007218993 | A | 8/2007 |
| JP | 2007264519 | A | 10/2007 |
| JP | 2008009059 | A | 1/2008 |
| JP | 2008020862 | A | 1/2008 |
| JP | 2008122715 | A | 5/2008 |

OTHER PUBLICATIONS

European search report for corresponding European application 09002337.5 lists the references above.

* cited by examiner

*Primary Examiner* — Hoan Tran
(74) *Attorney, Agent, or Firm* — DLA Piper LLP (US)

(57) ABSTRACT

A development roller includes a base unit having a base recess and a base projection that are formed in a predetermined area of a circumference surface of the base unit, and a surface layer formed on the circumference surface of the base unit and having on the circumference thereof a recess and a projection formed respectively in accordance with the base recess and the base projection of the base unit. Surface hardness of the projection is higher than surface hardness of the recess.

20 Claims, 15 Drawing Sheets

AGING OF DEVELOPMENT ROLLER

| | |
|---|---|
| ROUGHNESS DEPTH | 6 μm |
| ROUGHNESS PITCH | 100 μm |
| PROJECTION WIDTH | 60 μm |
| RECESS WIDTH | 40 μm |

TONER PARTICLE DIAMETER < ROUGHNESS DEPTH OF DEVELOPMENT ROLLER

AGING OF DEVELOPMENT ROLLER

RUBBING TEST RESULTS

ACTUAL APPARATUS TEST RESULTS
NON-ANNEALED PRODUCT

400°C ANNEALED PRODUCT

LOW ABSOLUTE VALUE → LOW SATURATION CHARGE
LOW RECOVERY PERFORMANCE → LOW CHARGING RESPONSE

AGING OF DEVELOPMENT ROLLER

| | |
|---|---|
| ROUGHNESS DEPTH | 6 μm |
| ROUGHNESS PITCH | 100 μm |
| PROJECTION WIDTH | 60 μm |
| RECESS WIDTH | 40 μm |

TONER PARTICLE DIAMETER > ROUGHNESS DEPTH OF DEVELOPMENT ROLLER

AGING OF DEVELOPMENT ROLLER

DEVELOPMENT ROLLER, DEVELOPMENT DEVICE, IMAGE FORMING APPARATUS, AND METHOD OF MANUFACTURING DEVELOPMENT ROLLER

BACKGROUND

1. Technical Field

The present invention relates to a development roller having a roughness on the circumference thereof for transporting toner to a latent image bearing unit, a development device containing the development roller, an image forming apparatus containing the development device, and a method of manufacturing the development roller.

2. Related Art

Development devices developing a toner image from a latent image with one-component non-magnetic toner triboelectrically charge the toner on a development roller. A development roller known in the related art (such as the one disclosed in Japanese Unexamined Patent Application Publication No. JP-A-2007-121948) has a surface roughness on the circumference thereof, the roughness having a substantially flat top surface. With the surface roughness, the development roller triboelectrically charges the toner thereon. As illustrated in FIG. 10A, a development roller a includes a base unit b and a surface layer c plated on the base unit b as a coverage.

The development roller a generally remains in contact with a toner feed roller and a toner regulator (both not shown). Silica having a high hardness is used serving as an external additive that coats toner mother particles of the toner. A roughness portion, composed of a plurality of recesses d and projections e, is formed on the circumference of the base unit b. A roughness portion, composed of a plurality of recesses f and projections g, is formed on the circumference of the surface layer c.

The surface layer c is worn by the toner feed roller and the toner regulator in an image forming operation. A demand for high-quality image and reduction in toner consumption is mounting today. The particle diameter of the toner currently becomes smaller. If the image forming operation has been performed with the small particle size toner for a long period of time, the surface of the top portion h of the projection g is relatively heavily worn in a generally flat configuration while the surface of the recess f is generally unworn as illustrated in FIG. 10B. If the degree of wear is different from the recess f to the projection g, the depth of the roughness portion is reduced in the long service life of image forming of the development roller. The amount of toner transported by the development roller is thus reduced. It becomes difficult to maintain the image density level of each image and to continue the development process for a long period of time.

SUMMARY

An advantage of some aspects of the invention is that a development roller remains operative in an image forming operation thereof for a long period of time with a reduction of a depth of a roughness portion of the development roller controlled as much as possible. An advantage of the invention is also that a development device and an image forming apparatus, each containing the development roller, also remain operative in the image forming operation thereof for a long period of time.

In accordance with one embodiment of the invention, surface hardness of a projection is higher than surface hardness of a recess in the roughness portion of the development roller.

In the long service life of image forming, the wearing of a surface layer at the projection, likely to be subject to wear, is controlled. A difference between the degree of wear of the surface layer at the recess subject to mild wearing and the degree of wear of the surface layer at the project is smaller than a difference caused in the related art. A change in the depth of the roughness portion of the development roller is controlled in the long service life of the development roller. The amount of toner transported by the development roller remains almost unchanged. The image density level of images developed is maintained substantially at a constant level. Excellent development process is thus performed for a long period of time.

Surface hardness of the recess of the development roller is set to be small so that the surface at the recess is positively abraded. This arrangement prevents filming from taking place. Filming is caused by degraded toner building up in the recess that typically suffers from a poor toner refreshing characteristics by the toner feed roller. Furthermore, since the recess is spaced from a toner regulator blade, a toner charging property tends to be lowered. A decrease in the toner charging property is controlled by keeping the recess amorphous. This arrangement controls toner coverage or toner splashing, leading to excellent development characteristics.

In a toner transport method in which toner is not transported to the surface of the projection with a toner regulator unit, a function of the recess for maintaining the toner charging property at the surface of the recess is separated from a function of the projection for maintaining wear proofness on the surface of the projection. The two functions are thus separately performed.

The toner charging property of the projection is lowered by crystallizing the top portion of the projection. A low toner charging property prevents chargeup from taking place between the toner regulator blade and the projection of the development roller, thereby improving development results. In a toner transport method, toner having a toner particle size smaller than a depth of the roughness portion of the development roller is transported to the recess of the development roller with a front edge of the toner regulator blade placed into contact with the development roller, and the toner is not transported to the projection. In such a toner transport method, the supply of the toner to the projection is more effectively controlled. Filming of the toner on a flat portion of the projection and chargeup of the toner are thus prevented.

The roughness portion of the surface layer is constructed of the same material and the degree of crystallization is differentiated between the projection and the recess (for example, the projection is set to be higher in the degree of crystallization than the recess). With this arrangement, the surface hardness and electrical resistance of the projection and recess can be controlled. The surface layer at the recess and the projection is not fully crystallized. The surface composition of the development roller is thus easily set up. Filming (toner fusion) takes place if the wear of the projection is too small as a result of high hardness thereof. By controlling the degree of crystallization, the generation of filming is controlled.

By allowing the projection of the surface layer to be heated in a localized fashion, the base unit is almost free from crystallization. The base unit is thus free from release of stress, and bowing and bending responsive to variations in the degree of crystallization.

An area of the projection where crystallization advances is limited to within an average particle diameter of toner in use from the top surface of the projection. The toner particles transported to the recess that is subject to a decrease in charging property are thus allowed to be in contact with the amorphous recess. This arrangement prevents the toner from being lowered the in toner charging property. More specifically, the toner is effectively charged by setting the toner charging property of the recess to be higher than the toner charging property of the projection.

The surface layer is on the base unit through electroless plating before the formation of the roughness portion on the base unit. Even if a material relatively hard to machine is used for the base unit, the configuration stability of the roughness portion is improved by the plated surface layer. The roughness portion has an increased surface smoothness, allowing the toner particles to be moved smoothly. Filming of the toner at the recess is thus controlled. The toner transportability and the toner charging property are excellently maintained.

The development device containing the development roller of one embodiment of the invention can perform the development process on electrostatic latent images on a latent image bearing unit for a long period of time. The image forming apparatus containing the development device can thus provide stable and excellent-quality images for a long period of time.

In accordance with another aspect of the invention, surface hardness of the base unit is set to be higher than surface hardness of the surface layer if the surface layer includes one layer only. Surface hardness of a layer immediately inside the outermost layer is set to be higher than surface hardness of the outmost layer if the surface layer includes a plurality of layers. If the surface layer at the flat portion of the projection of the base unit or the outermost surface layer at the flat portion of the projection of the base unit is worn by the toner regulator blade, the toner feed roller, or the toner external additive, the flat portion of the base unit or the surface layer immediately beneath the outermost layer is exposed. The wear rate of the projection of the development roller is then reduced. In this way, the durability of the development roller is increased.

If the surface layer or the outermost layer is worn out, the depth of the roughness portion of the development roller slightly changes. The wearing of the exposed flat portion or the surface layer immediately below the outmost layer is controlled. As a result, a change in the depth of the roughness portion of the development roller is controlled for a long period of time. The depth of the roughness portion is thus maintained for a long period of time. The amount of toner transported to the development roller remains almost unchanged. The density level of the images is maintained at a substantially constant level for a long period of time. An excellent development process is thus provided for a long period of time.

The toner charging property of the exposed flat portion or the exposed surface layer immediately below the outmost layer, at the projection is lowered. Toner particles pinched between the development roller and the toner regulator blade result in stronger frictional force than that at the recess. A decrease in the toner charging property is controlled accordingly. Toner coverage and toner splashing are controlled, and excellent development characteristics are thus provided.

In a toner transport method in which toner is not transported to the surface of the projection with a toner regulator blade, a function of the recess for maintaining the toner charging property at the surface of the recess is separated from a function of the projection for maintaining wear proofness on the surface of the projection (maintaining the depth of the roughness portion). The two functions are separately performed.

The thickness of one of the surface layer and the outermost layer is set to be within an average particle diameter (D50 particle diameter) of the toner in use. The toner transported to the recess subject to a decrease in the charging property is placed into contact with the amorphous recess. A decrease in the toner charging property is controlled.

One of the surface layer and the outermost layer of a plurality of layers is removed through a grinding process of a grinding machine or a polishing process of a polishing machine. Even if a development roller having an exposed flat portion of the base projection or an exposed surface layer immediately beneath the outermost layer is used from the start, the same operation and advantages as those described above may be provided.

The development device containing the development roller can develop toner images on the latent image bearing unit in accordance with the electrostatic latent images for a long period of time. The image forming apparatus containing the development device can provide stable and excellent-quality images for a long period of time.

BRIEF DESCRIPTION OF THE DRAWINGS

The invention will be described with reference to the accompanying drawings, wherein like numbers reference like elements.

DESCRIPTION OF EXEMPLARY EMBODIMENTS

The embodiments of the invention are described below with reference to the drawings.

Figure 1:
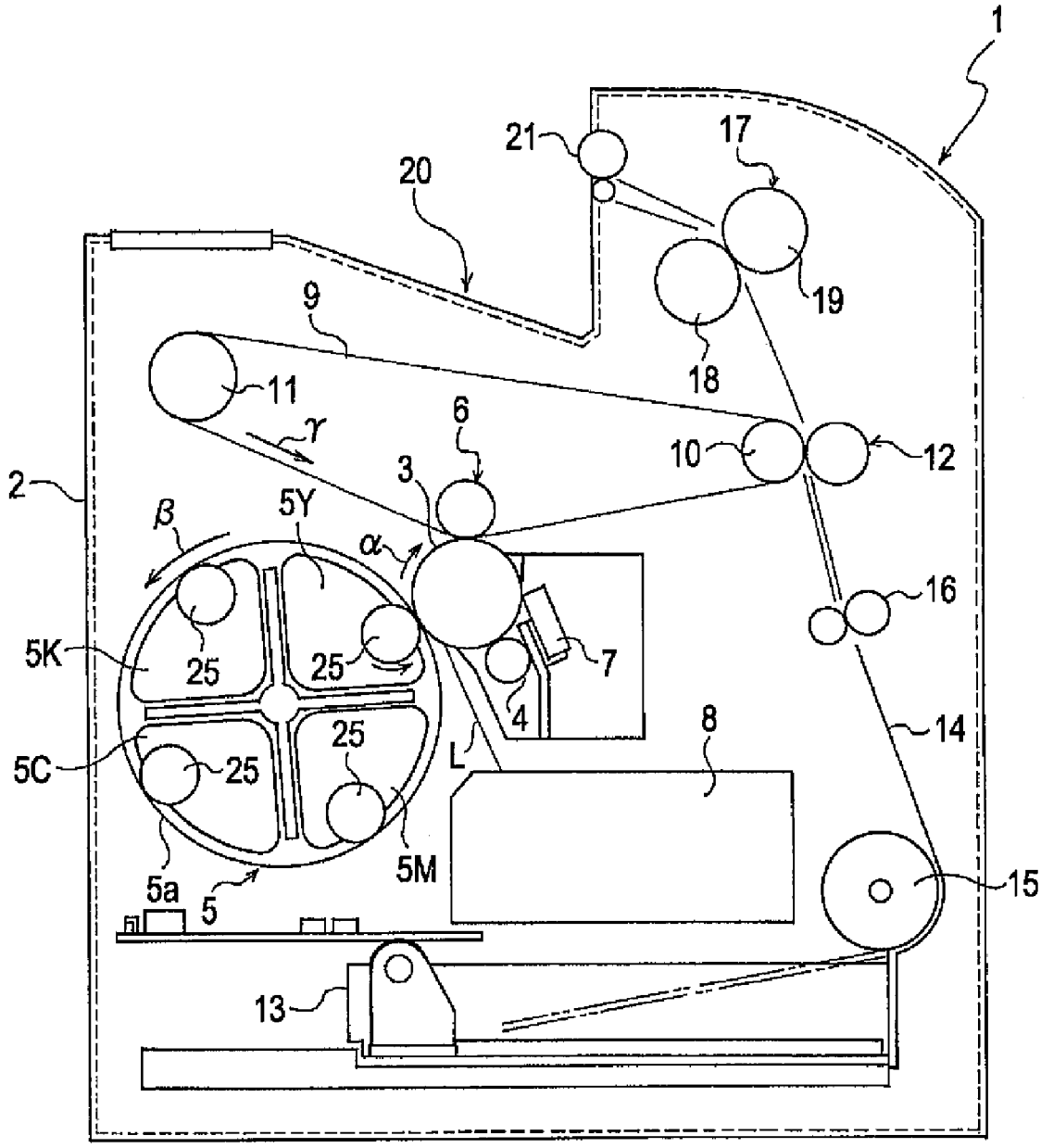
FIG. 1 illustrates an image forming apparatus in accordance with one embodiment of the invention.

FIG. 1 diagrammatically illustrates an image forming apparatus 1 in accordance with one embodiment of the invention.

With reference to FIG. 1, a photoconductor unit 3 as an image bearing unit is supported in an apparatus body 2 in a manner such that the photoconductor unit 3 is clockwise rotated in a direction of rotation a. A charging device 4 is arranged in the vicinity of the circumference of the photoconductor unit 3. Also arranged in the direction of rotation a of from the charging device 4 to the photoconductor unit 3 around the photoconductor unit 3 are a rotary development unit 5 as a development device, a primary transfer device 6, and a cleaning device 7. The rotary development unit 5 includes a development device 5Y for yellow color, a development device 5M for magenta color, a rotary development unit 5C for cyan color, and a development device 5K for black. These development devices 5Y, 5M, 5C and 5K are detachably supported in a rotary 5*a* that is rotatable about a center axis in a direction of rotation β (counterclockwise rotation in FIG. 1). An exposure device 8 is arranged below the charging device 4 and the cleaning device 7.

The image forming apparatus 1 further includes an intermediate transfer belt 9 having an endless structure as an intermediate transfer medium. The intermediate transfer belt 9 is entrained about a belt driving roller 10 and a driven roller 11. A driving force of a motor (not shown) is conveyed to the belt driving roller 10. The belt driving roller 10 causes the intermediate transfer belt 9 to rotate in a rotational direction 7 (counterclockwise rotation in FIG. 1) while the intermediate transfer belt 9 is pressed by the primary transfer device 6 against the photoconductor unit 3.

A secondary transfer device 12 is arranged next to the belt driving roller 10 of the intermediate transfer belt 9. A transfer material cassette 13 is arranged below the exposure device 8. The transfer material cassette 13 holds a sheet-like transfer material such as a transfer paper sheet (corresponding to a transfer medium in accordance with one embodiment of the invention). A pickup roller 15 and a gate roller 16 are arranged close to the secondary transfer device 12 in a transfer material transport path 14 extending from the transfer material cassette 13 to the secondary transfer device 12.

A fixing device 17 is arranged above the secondary transfer device 12. The fixing device 17 includes a heater roller 18 and a pressure roller 19 pressed against the heater roller 18. A transfer material discharge tray 20 is arranged on the top portion of the apparatus body 2. A pair of transfer material discharge rollers 21 are arranged between the fixing device 17 and the transfer material discharge tray 20.

In the image forming apparatus 1 thus constructed, a yellow electrostatic latent image, for example, is formed on the photoconductor unit 3 uniformly charged by the charging device 4 in response to laser light L from the exposure device 8. The yellow electrostatic latent image is developed on the photoconductor unit 3 by yellow toner of the yellow development device 5Y at a development position (not shown) determined when the rotary 5*a* rotates. A yellow toner image is thus developed on the photoconductor unit 3. The yellow toner image is then transferred to the intermediate transfer belt 9 by the primary transfer device 6. Toner remaining on the photoconductor unit 3 subsequent to the transfer operation is scraped off by a cleaning blade or the like of the cleaning device 7 and then recycled.

Similarly, a magenta image is formed by the exposure device 8 on the photoconductor unit 3 that is uniformly charged by the charging device 4. The magenta electrostatic latent image is developed by magenta toner of the magenta development device 5M at the development position. The magenta image on the photoconductor unit 3 is transferred to the intermediate transfer belt 9 by the primary transfer device 6 in a manner such that the magenta image is superimposed on the yellow image. Toner remaining on the photoconductor unit 3 subsequent the transfer operation is recycled by the cleaning device 7. A similar operation is repeated for cyan and black toners. The toner images are successively formed on the photoconductor unit 3, and then superimposed on the preceding toner images on the intermediate transfer belt 9. A full-color toner image is then formed on the intermediate transfer belt 9. Similarly, toner remaining on the photoconductor unit 3 subsequent to each transfer operation is recycled by the cleaning device 7.

The full-color toner image transferred onto the intermediate transfer belt 9 is then transferred by the secondary transfer device 12 to the transfer material transported from the transfer material cassette 13 via the transfer material transport path 14. The transfer material is then transported to the secondary transfer device 12 at a timing with the full-color toner image of the intermediate transfer belt 9 by the gate roller 16.

The toner image pre-fixed to the transfer material is heated and pressure-fixed by the heater roller 18 and the pressure roller 19 in the fixing device 17. The transfer material having the image thereon is transported via the transfer material transport path 14, discharged to the transfer material discharge tray 20 via the transfer material discharge roller pair 21 and then held there.

A characteristic structure of the image forming apparatus 1 is described below.

The development devices 5Y, 5M, 5C, and 5K in the image forming apparatus 1 are identical in structure. In the discussion that follows, the rotary development unit 5 is representatively discussed without individually referring to the development devices 5Y, 5M, 5C, and 5K. In this case, reference number 51 is used to discriminate the development device from the rotary development unit 5.

Figure 2:
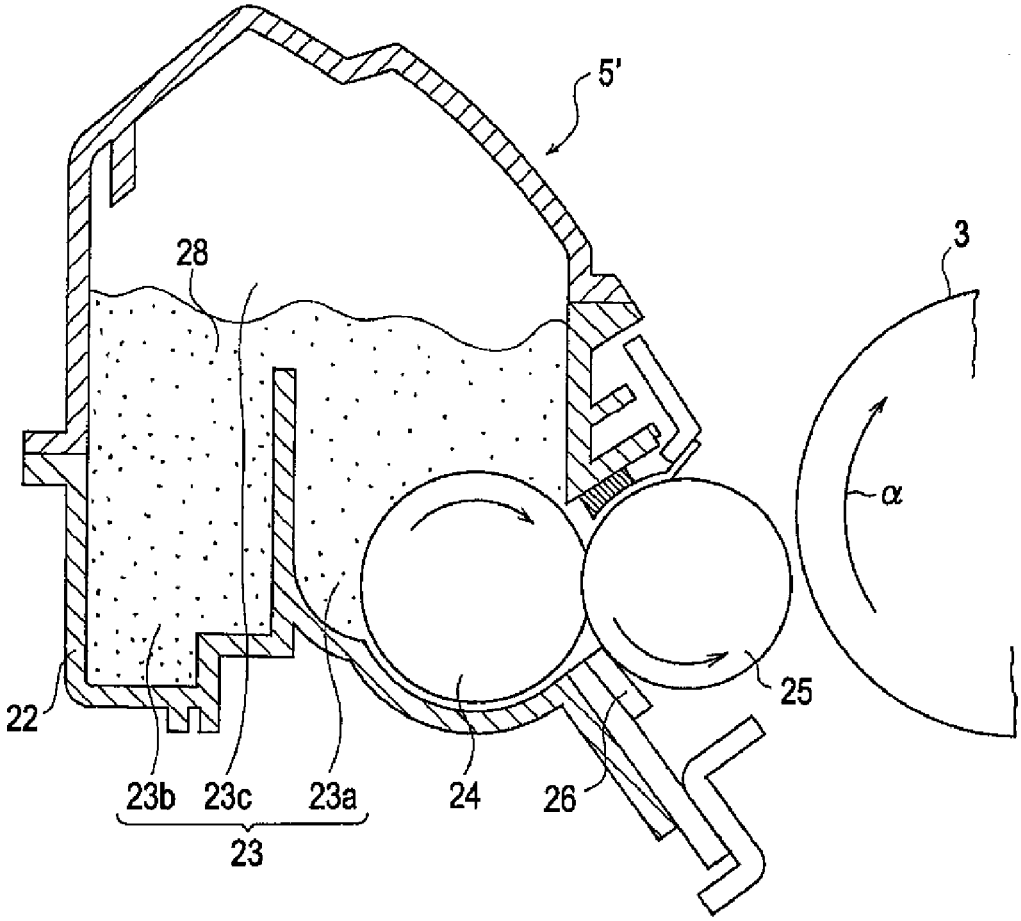
FIG. 2 is a sectional view diagrammatically illustrating a development device illustrated in FIG. 1.

FIG. 2 is a sectional view of the development device 5' taken in a direction perpendicular to the longitudinal direction of the development device 5' in accordance with one embodiment of the invention.

The development device 5' has a form of an elongated container. With reference to FIG. 2, the development device 5' has the same structure as the development device disclosed in Japanese Unexamined Patent Application Publication No. JP-A-2007-121948. More specifically, the development device 5' includes in an elongated housing 22 a toner container 23, a toner feed roller 24, a development roller 25, and a toner regulator member 26. The toner container 23, the toner feed roller 24, the development roller 25, and the toner regulator member 26 extend in the longitudinal direction of the development device 5' (i.e., in a direction perpendicular to the plane of the page of FIG. 2).

The toner container 23 is partitioned into two toner compartments 23*a* and 23*b* by a partitioning wall 27. The toner container 23 includes a common section 23*c* through which the first and second toner compartments 23*a* and 23*b* are open to each other in FIG. 2. The partitioning wall 27 limits the movement of toner 28 between the first and second toner compartments 23*a* and 23*b*. When the development device 5' is turned upside down from the position illustrated in FIG. 2 with the rotary 5*a* of the rotary development unit 5 rotated, the toner 28 stored in each of the first and second toner compartments 23*a* and 23*b* moves to the common section 23*c*. The rotary 5*a* further rotates, causing the development device 5' to be positioned to the state illustrated in FIG. 2. The toner 28 then moves back to each of the first and second toner compartments 23*a* and 23*b*. In this way, part of the toner 28 previously held in the first toner compartment 23*a* is moved to the second toner compartment 23*b* and part of the toner 28 previously held in the second toner compartment 23*b* is moved to the first toner compartment 23*a*. The toner 28 is thus agitated within the toner container 23. The toner 28 is one-component, non-magnetic toner with toner mother particles thereof coated with an external additive. In accordance with one embodiment of the invention, the external additive contains at least silica.

Referring to FIG. 2, the toner feed roller 24 is arranged in the lower portion of the first toner compartment 23*a* in a manner such that the toner feed roller 24 is clockwise rotatable. The development roller 25 is counterclockwise rotatably supported on the outside of the housing 22 as illustrated in FIG. 2. The development roller 25 is arranged close to the photoconductor unit 3 (in a non-contact fashion). The development roller 25 is pressed against the toner feed roller 24 at a predetermined pressure through an opening 22*a* of the housing 22. The toner regulator member 26 is also arranged on the housing 22. The toner regulator member 26 remains in contact with the development roller 25 downstream of a nip (contact point) between the development roller 25 and the toner feed roller 24. The toner regulator member 26 regulates a thickness of the toner 28 fed to the development roller 25 from the toner feed roller 24. The toner 28 regulated by the toner regulator member 26 is transported to the photoconductor unit 3 by the development roller 25. The electrostatic latent image is thus developed into the toner image on the photoconductor unit 3 by the toner 28 transported by the development roller 25. The toner image of each color thus results on the photoconductor unit 3.

Figure 3A:
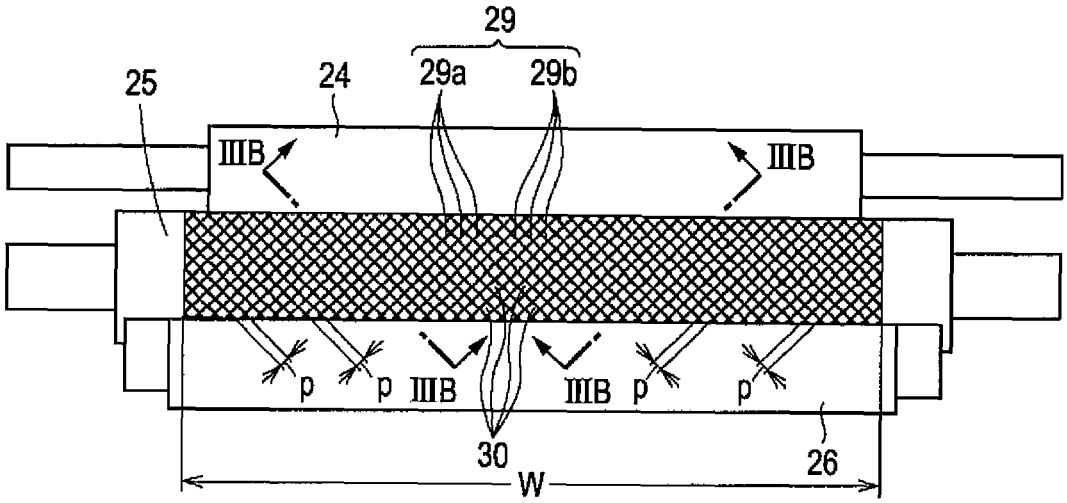
FIG. 3A diagrammatically illustrates a development roller, a toner feed roller, and a toner regulator unit.
Figure 3B:
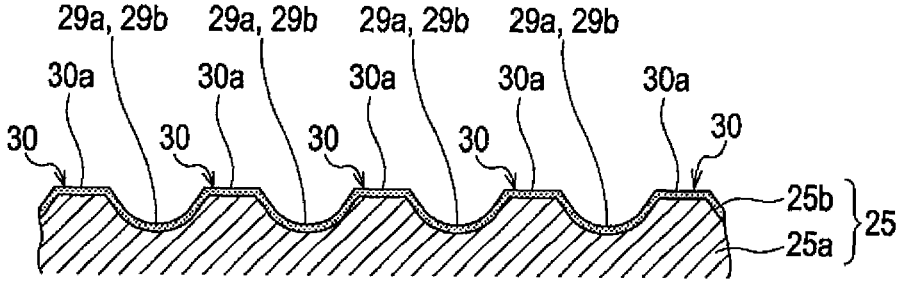
FIG. 3B is a partial sectional view illustrating part of the development roller and taken along line IIIB-IIIB in FIG. 3A.
Figure 3C:
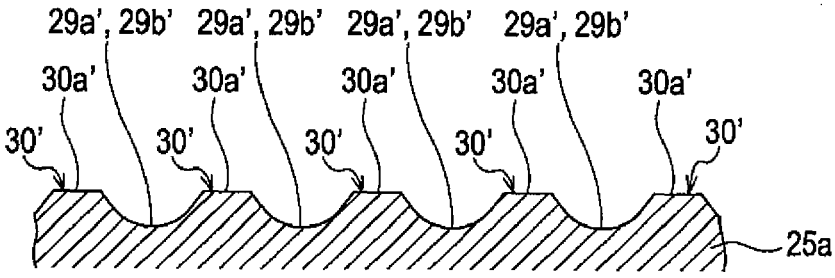
FIG. 3C is a partial sectional view illustrating only a base unit of the development roller.

FIGS. 3A-3C illustrate the circumference surface of the development roller 25 that has the same mesh roughness pattern as the one on the development roller discussed with reference to Japanese Unexamined Patent Application Publication No. JP-A-2007-121948. In the development roller 25, grooves 29 are formed in a roughness pattern in predetermined positions in the axial direction thereof on the whole circumference surface. The grooves 29 include first grooves 29*a* of a predetermined number continuously spiraling at a predetermined angle with respect to the axial direction of the development roller 25 (the predetermined angle is 45° in FIG. 3A, but not limited to 45°), and second grooves 29*b* of a predetermined number continuously spiraling at an angle opposite to the slant angle of the first grooves 29*a*. The first and second grooves 29*a* and 29*b* are formed at the respective slant angles at a predetermined pitch p with regular interval of W along the axial direction of the development roller 25. The first and second grooves 29*a* and 29*b* may be different from each other in slant angle and pitch.

With reference to FIG. 3B, the development roller 25 includes a base unit 25*a*, and a surface layer 25*b* formed on the circumference surface of the base unit 25*a*. The base unit 25*a* is a metal sleeve made of an aluminum based metal such as 5056 aluminum alloy or 6063 aluminum alloy, or an iron based metal such as STKM steel. The surface layer 25*b* is a nickel-based or chromium-based layer plated on the base unit 25*a*.

Referring to FIG. 3C, first and second grooves 29*a*' and 29*b*, for forming the first and second grooves 29*a* and 29*b* are formed on the circumference surface of the base unit 25*a* of the development roller 25 through component rolling. The machining method of forming the first and second grooves 29*a*' and 29*b*' may be any known method. The discussion of the machining method is thus omitted here. The base unit 25*a* has island projections 30' of a predetermined number surrounded by the first and second grooves 29*a*' and 29*b*'. In the discussion of the specification, the base recess refers to a portion of the base unit 25*a* deeper than half the depth of each of the first and second base grooves 29*a*' and 29*b*' and the base projection 30' refers to a projection of the base unit 25*a* externally protruded from half the depth of each of the first and second base grooves 29*a*' and 29*b'*.

Figure 4:
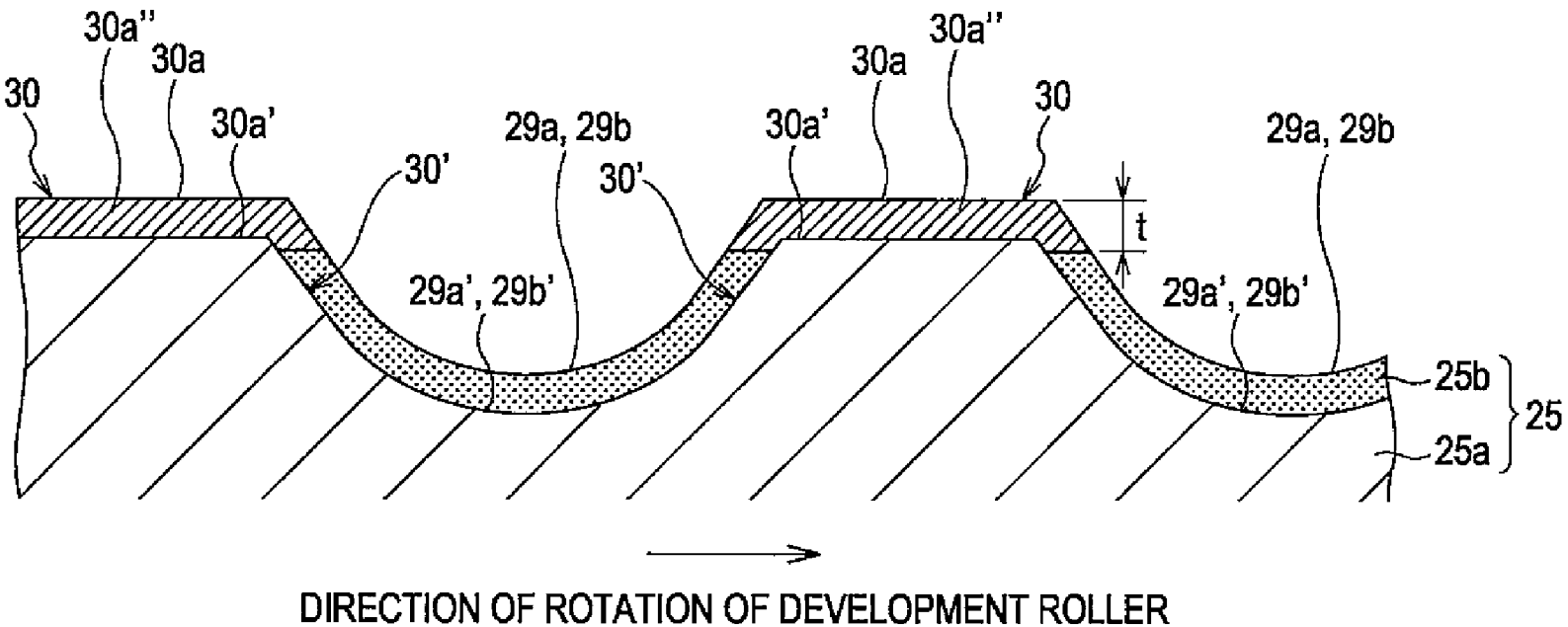
FIG. 4 is a partial sectional expanded view of the development roller illustrated in FIG. 3B.

Referring to FIGS. 3C and 4, the top portion of the base projection 30' is a the base flat surface 30*a*1. The base flat surface 30*a* of the base projection 30' is square if the first and second base grooves 29*a*' and 29*b*' have a slant angle of 45.degree. and the same pitch p, and is diamond if the first and second slant base grooves 29*a*' and 29*b*' have a slant angle of other than 450 and the same pitch p. The base flat surface 30*a*' of base projection 30' is rectangular if the first and second base grooves 29*a*' and 29*b*' have a slant angle of 45.degree. and different pitches p, and is parallelogrammic if the first and second base grooves 29*a*' and 29*b*' have a slant angle of other than 45.degree, and different pitches p. Regardless of the type of quadrilateral of the flat surface 30*a*', the base flat surface 30*a*' of the base projection 30' becomes a quadrangular pyramid frustum with four inclined walls.

Each of the first and second base grooves 29*a*' and 29*b*' has a curved recess surface in a sinusoidal wave configuration along an inclination direction. Each of the four side walls of the quadrangular pyramid frustum of the base projection 30' is continued to the curved recess surface in a sinusoidal wave configuration. The four side walls of the quadrangular pyramid frustum of the base projection 30' are respectively continued to the four side walls of the sinusoidal wave curved recesses at half the depth of the roughness portion.

The circumference surface of the base unit 25*a* having the first and second base grooves 29*a*' and 29*b*' and the base projections 30' is electroless nickel plated. The surface layer 25*b* is thus formed on the surface of the base unit 25*a*. A first and second grooves 29*a* and 29*b* and a projection 30 are formed on the surface layer 25*b* in a configuration similar to the first and second base grooves 29*a*' and 29*b*' and the base projection 30'.

A flat top portion 30*a* having a quadrilateral shape is formed on the projection 30. With the surface layer 25*b* formed on the base unit 25*a*, the top portion 30*a* continued to the first and second grooves 29*a* and 29*b* has a quadrangular pyramid frustum with four inclined side walls. The four side walls of the quadrangular pyramid frustum are respectively continued to the four side walls of the first and second grooves 29*a* and 29*b* having a sinusoidal wave configuration.

The development roller 25 has on the surface layer 25*b* at the top portion 30*a* of the projection 30 a high-hardness portion 30*a*" having hardness higher than surface hardness of the other portions (see FIG. 4). An area of the projection 30 within which the high-hardness portion 30*a*" is formed (to a depth t from the top surface of the projection 30) is set to be within an average particle diameter of the toner in use. The area of the surface layer 25*b* including the first and second grooves 29*a* and 29*b* but excluding the high-hardness portion 30*a*" provides a toner charging property higher than that of the high-hardness portion 30*a*".

Figure 10A:
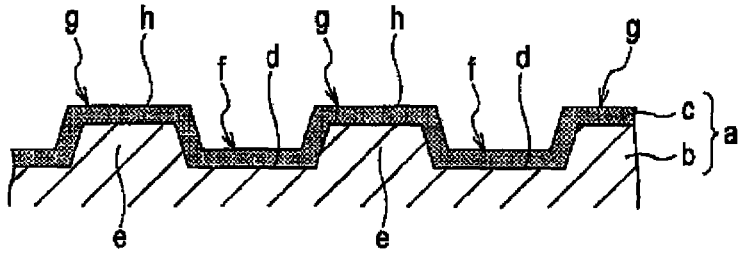
FIG. 10A PRIOR ART
FIG. 10A is a partial sectional view of a roughness portion of a known development roller.
Figure 10B:
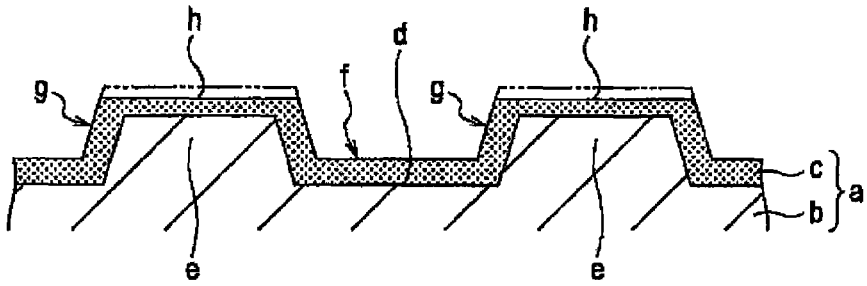
FIG. 10B PRIOR ART
FIG. 10B illustrates the wear of the roughness portion illustrated in FIG. 10A.

The top portion g of the development roller a is relatively heavily worn in a flat configuration while the surface layer c of the recess formation portion f of the first and second grooves is not worn in practice as illustrated in FIG. 10B. The inventor of the invention has studied this phenomenon by conducting durability tests. The wear trace was measured using Keyence VK-9500 as a three-dimensional measuring laser microscope. The image forming apparatus used in the tests is printer model LP9000C manufactured by Seiko Epson. A development roller 25 to be discussed below was used instead of the original development roller in the printer model LP9000C. Printer model LP9000C was modified to employ the development roller 25. Image forming conditions in the durability tests were the standard image forming conditions of the printer model LP9000C.

Figure 5A:
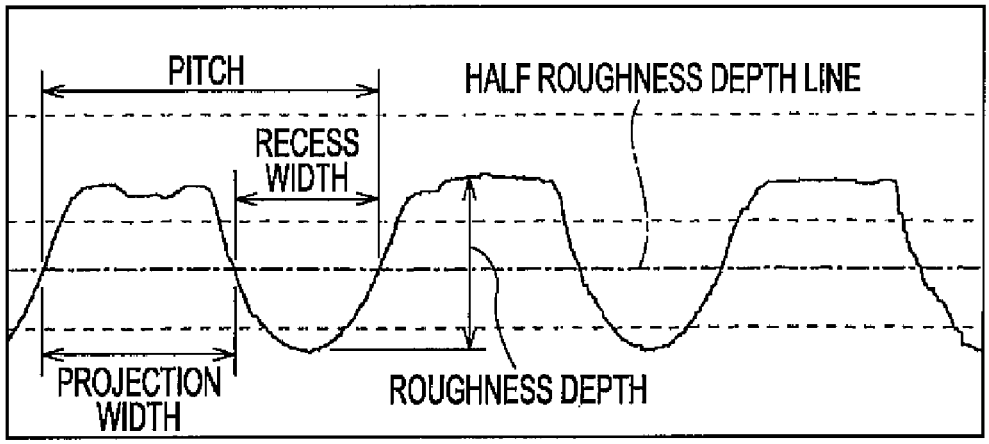
FIG. 5A illustrates a size of a roughness of the development roller.

Before forming the roughness portion on the base unit 25*a*, the base unit 25*a* of the development roller 25, made of STKM steel, was centerless machined in surface finishing. The first and second base grooves 29*a*' and 29*b*' were formed on the base unit 25*a* through component rolling. A nickel-phosphorus (Ni—P) layer is electroless plated to a thickness of 3 μm as the surface layer 25*b* on the base unit 25*a*. As illustrated in FIG. 5A, the development roller 25 was machined as below. In the development roller 25, the roughness depth (height from the bottom of the grooves 29*a* and 29*b* to the top surface of the projections 30) was 6 μm, the roughness pitch was 100 μm, the width of the projection 30 along a line extending at half the roughness depth was 60 μm, and the width of the recess along the half line was 40 μm.

The toner feed roller 24, made of urethane foam, was installed to press against the development roller 25 by an amount of sink of 1.5 mm. The toner regulator member 26 was constructed of a blade made of urethane rubber, and installed to be pressed against the development roller 25 under a pressure of 40 g/cm.

Two types of toner were used. A first type of toner was produced by manufacturing polyester particles through a pulverizing process, and by internally dispersing proper amounts of a charge control agent (CCA), a wax, and a pigment with the polyester particles into toner mother particles. Then externally added to the toner mother particles were small silica particles having a size of 20 nm, median silica particles having a size of 40 nm, large silica particles having a size of 100 nm, and titania particles having a size of 30 nm. The process resulted in small size toner having an average diameter D50 of 4.5 μm, and smaller than the roughness depth of 6 μm. A second type of toner was produced by manufacturing styrene acrylate particles through a polymerization process, and by internally dispersing proper amounts of a wax, and a pigment with the styrene acrylate particles into toner mother particles. Then externally added to the toner mother particles were small silica particles having a size of 20 nm, median silica particles having a size of 40 nm, large silica particles having a size of 100 nm, and titania particles having a size of 30 nm. The process resulted in small size toner having an average diameter D50 of 4.5 μm.

Figure 5B:
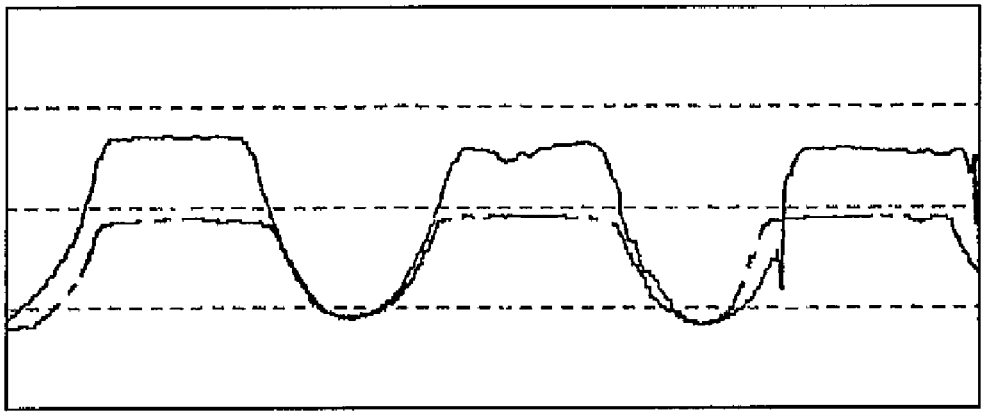
FIG. 5B illustrates a wear process of the development roller when a toner particle diameter is larger than a depth of the roughness of the development roller.

Durability image forming tests were conducted on A4 size standard sheets using a text pattern having a monochrome image occupancy rate of 5% under the standard image forming condition of the printer model LP9000C. When the first type small size toner was used, the top four side edges of the top portion 30*a* of the surface layer 25*b* at the projection 30 having an initial profile denoted by a solid line in FIG. 5B tended to be worn into a flat profile denoted by a dot-and-dash chain line as the number of image forming cycles increased. When the second type small size toner was tested, the projections 30 tended to be worn into a profile similarly curved profile obtained when the first type toner was used.

The possible reason why such a curved wear profile occurred is described below. As the development roller 25 rotates in FIG. 6A, the toner feed roller 24 and the toner regulator member 26 are respectively pressed against the development roller 25. Toner particles present on the flat surfaces 30*a* of the projections 30 move into the first and second grooves 29*a* and 29*b*. Since the average diameter (D50 particle diameter) of the toner particles is smaller than the roughness depth, almost all the toner particles of the toner 28 having moved into the first and second grooves 29*a* and 29*b* are arranged in a plurality of layers. As the development roller 25 further rotates, toner particles present in the first and second grooves 29*a* and 29*b* move onto the flat surfaces 30*a* of the projections 30. Since the top layer of toner particles is then about at the same level as the flat surface 30*a* of the projection 30, mainly the toner particles at the top layer out of the toner particles in the first and second grooves 29*a* and 29*b* horizontally move, and most of the remaining toner particles at the lower layers remain stationary. In the course of the movement of the top layer toner particles, the external additive having a relatively high hardness coating the toner mother particles gradually wears the surface of the surface layer 25*b* into a substantially flat state for a long period of time.

Figure 6A:
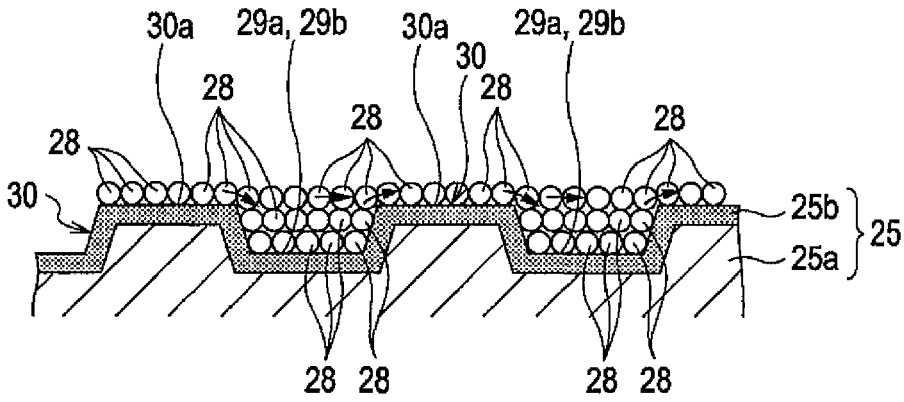
FIG. 6A illustrates the behavior of toner particles when the toner particle diameter is smaller than the depth of the roughness of the development roller.
Figure 6B:
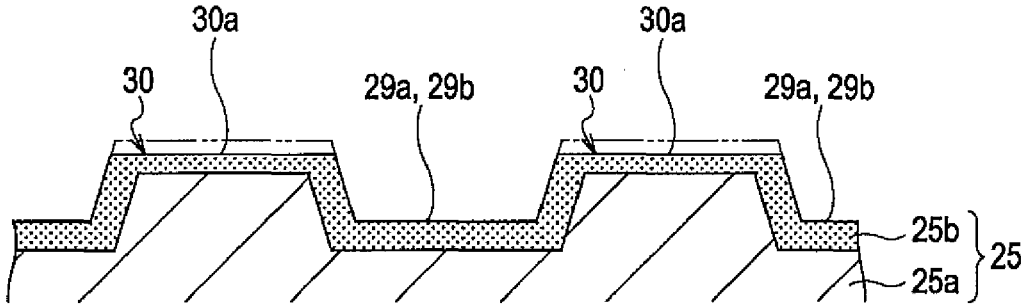
FIG. 6B illustrates the wear state of the development roller of FIG. 6A.

As FIG. 3B, FIGS. 6A and 6B are sectional views of the first and second grooves 29*a* and 29*b* taken along a line perpendicular to the running direction (slant angle) of the grooves. The partial sectional views of the development roller 25 are not aligned with the direction of rotation of the development roller 25. Toner particles on the first grooves 29*a* thus move onto the flat surfaces 30*a* of the projections 30, and then move to any of the first and second grooves 29*a* and 29*b* adjacent to the projections 30. Furthermore, toner particles on the second grooves 29*b* move onto the flat surfaces 30*a* of the projections 30, and then move to any of the first and second grooves 29*a* and 29*b* adjacent to the projections 30. The toner movement is identical to the other examples of the development roller 25.

A method of manufacturing the development roller 25 having the above-described structure is described below.

Figure 7A:
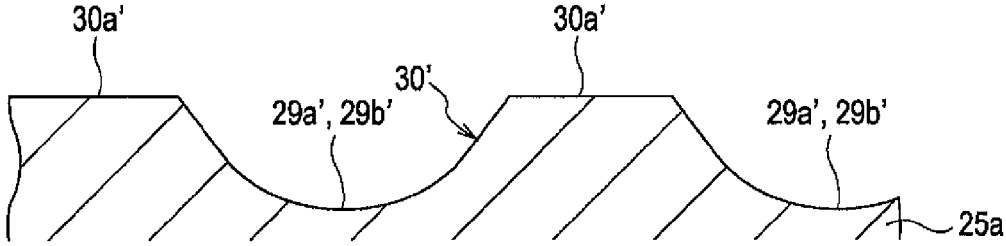
FIGS. 7A-7C illustrate a method of manufacturing the development roller illustrated in FIGS. 3A-3C and 4.
Figure 7B:
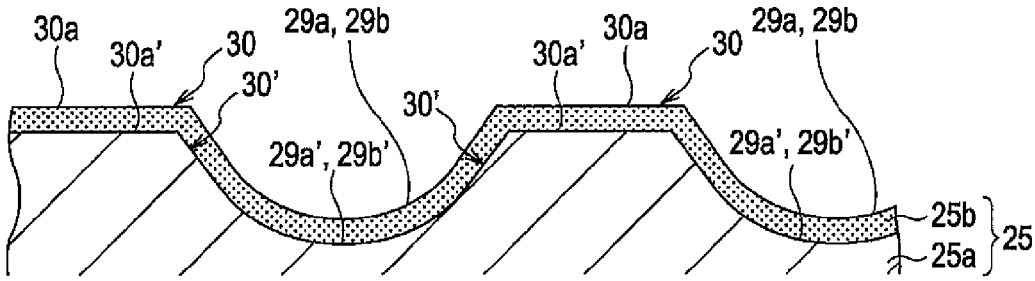

Referring to FIG. 7A, the first and second base grooves 29*a*' and 29*b*' are formed on the base unit 25*a* through component rolling. Referring to FIG. 7B, an amorphous surface layer 25*b* is formed through electroless plating on the base unit 25*a* having the first and second base grooves 29*a*' and 29*b*'. The first and second grooves 29*a* and 29*b* are thus formed in accordance with the first and second base grooves 29*a*' and 29*b*'. The projection 30 refers to the top portion 30*a* externally protruded from half the depth of each of the first and second grooves 29*a* and 29*b* and the recess refers to a portion of the base unit 25*a* (opposite to the top portion 30*a*) deeper than half the depth of each of the first and second grooves 29*a* and 29*b*. Hardness of the surface layer 25*b* is set to be higher than hardness of the base unit 25*a*.

Figure 7C:
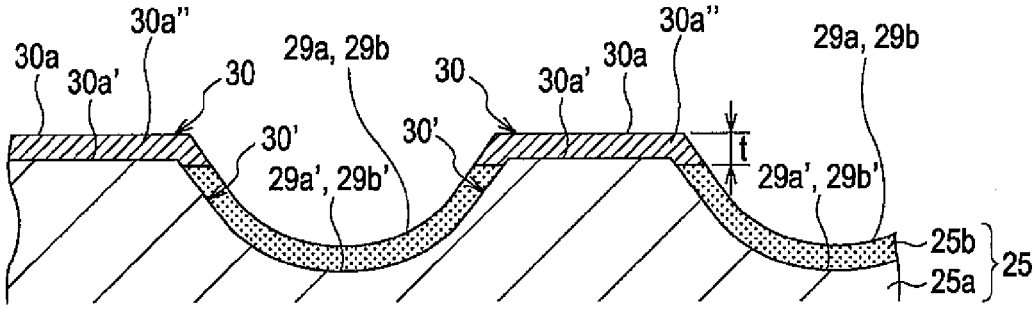

Referring to FIG. 7C, the surface layer 25*b* of the top portion 30*a* of the projection 30 is surface-crystallized by heating through ion beam or localized heating. A depth t of the surface-crystallized portion (high-hardness portion 30*a*") of the surface layer 25*b* is set to be within the toner average particle diameter (D50 particle diameter) of the toner used in the development device 5' containing the development roller 25. The surface hardness of the surface-crystallized portion (high-hardness portion 30*a*") of the surface layer 25*b* is set to be higher than surface hardness of the other area of the surface layer 25*b* covering the recess of the first and second grooves 29*a* and 29*b*. A toner charging property of the area of the surface layer 25*b* excluding the surface-crystallized portion (high-hardness portion 30*a*") is higher than a toner charging property of the high-hardness portion 30*a*".

Another method of manufacturing the development roller 25 is described below.

Figure 8A:
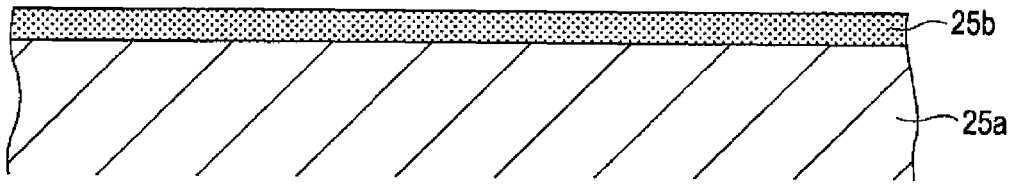
FIGS. 8A-8C illustrate another method of manufacturing the development roller illustrated in FIGS. 3A-3C and 4.
Figure 8B:
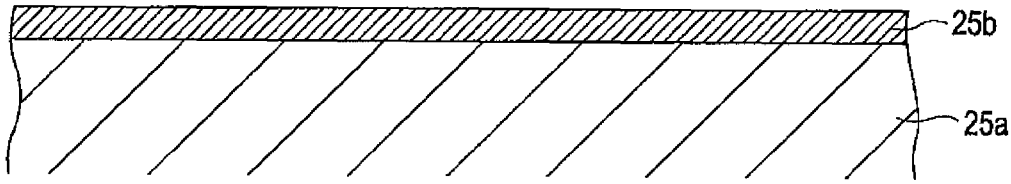
Figure 8C:
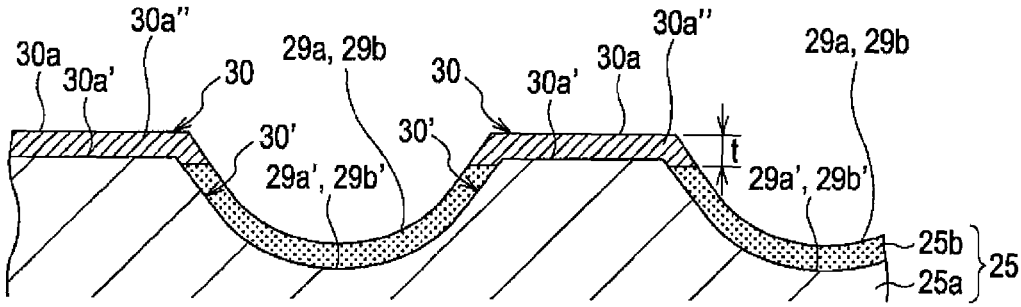

Referring to FIG. 8B, an amorphous surface layer 25*b* is formed through electroless plating on the surface of the base unit 25*a*. Hardness of the surface layer 25*b* is set to be higher than hardness of the base unit 25*a*. Referring to FIG. 8B, the amorphous surface layer 25*b* is fully crystallized through annealing. The annealing temperature then is 300° C. or higher, but equal to or lower than a thermal processing temperature of the base unit 25*a*. Referring to FIG. 8C, the first and second grooves 29*a* and 29*b* are thus formed on the crystallized surface layer 25*b* on the base unit 25*a* through component rolling. The projection 30 refers to the top portion 30*a* externally protruded from half the depth of each of the first and second grooves 29*a* and 29*b* and the recess refers to a portion of the base unit 25*a* (opposite to the top portion 30*a*) deeper than half the depth of each of the first and second grooves 29*a* and 29*b*. The area of the first and second grooves 29*a* and 29*b* on the crystallized surface layer 25*b* is again set to an amorphous state through component rolling. Hardness of the crystallized surface layer 25*b* of the top portion 30*a* becomes higher than hardness of the base unit 25*a*. The development roller 25 is thus produced.

The development roller 25 of one embodiment of the invention is specifically described below.

Before forming the roughness portion on the base unit 25*a*, the base unit 25*a* of the development roller 25, made of STKM steel having an Hv (Vickers hardness) of 150, was centerless machined in surface finishing. A base roughness portion having a depth of 6 μm was formed on the surface of the base unit 25*a* through component rolling. The base recesses 29*a*' and 29*b*' (the bottoms of the recesses of the projections 30') were formed in a sinusoidal wave configuration. The base flat surface 30*a*' of the base projection 30' was formed in a quadrangular pyramid frustum. The four inclined walls of the quadrangular pyramid frustum are formed respectively in continuation with the four walls of the sinusoidal wave recesses 29*a*' and 29*b*'. Points where the four side walls of the quadrangular pyramid frustum of the base projection 30' meet the four side walls of the sinusoidal wave curved recesses of the first and second grooves 29*a*' and 29*b*' are at half the depth of the base roughness portion.

A nickel-phosphorus (Ni—P) layer was electroless plated to a thickness of 3 μm as the surface layer 25*b* on the base unit 25*a*. The surface hardness of the surface layer 25*b* was an Hv of 550. The surface layer 25*b* of the top portion 30*a* was crystallized to within a depth t of 1.5 μm from the top surface of the projection 30 by heating the surface layer 25*b* with an ion beam directed thereto. The crystallized surface layer 25*b* had an Hv of 1000. More specifically, the high-hardness portion 30*a*" of the top portion 30*a* was higher in hardness than the remaining area of the surface layer 25*b* excluding the high-hardness portion 30*a*".

Tests were conducted to study a toner charging property and a surface potential of the development roller of one embodiment of the invention. The tests included a toner rubbing test to measure a toner charge amount and a surface potential test on a toner transport surface of the development roller.

A nickel-phosphorus (Ni—P) layer as a sample plate was electroless plated to a thickness of about 3 μm on an STKM development roller. Surface hardness of the sample plate was an Hv of 550. Another sample plate having the same specification was produced, and then the sample plate was annealed at 400° C. for two hours to crystallize the surface thereof. Surface hardness of the sample plate was an Hv of 1000. It was learned that the annealing process increased the hardness of the surface layer of the sample plate.

Figure 9A:
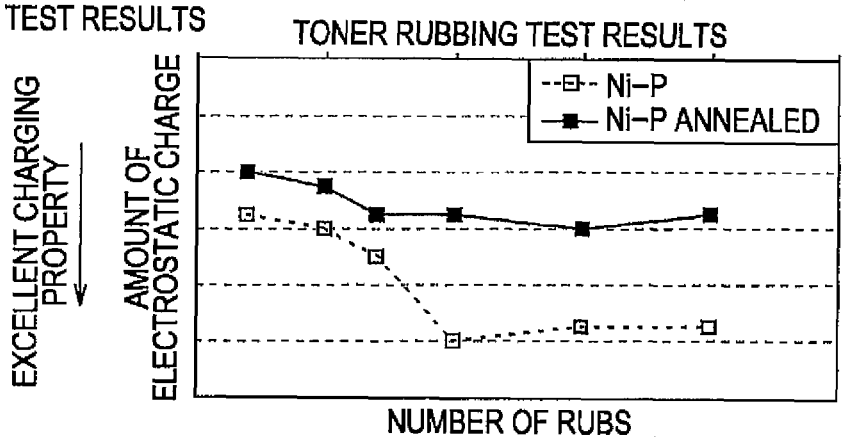
FIG. 9A illustrates toner rubbing test results and FIGS. 9B and 9C illustrate surface potential test results.

The first toner previously described was used here. A blade was produced of the same urethane rubber as the one used for the toner regulator blade 26. The toner was then dispersed on each sample plate, and the urethane rubber blade was rubbed on the toner on each sample plate. An amount of charge of rubbed toner was measured using an electric charge measuring instrument. The rubbing operation was repeated. Each time a predetermined number of rubbing operations was completed, the amount of toner charge was measured. FIG. 9A illustrates the toner rubbing test results. As illustrated in FIG. 9A, the sample plate with the plated layer not annealed provided a higher toner charging property.

In the surface potential test of the toner transport surface of the development roller, a test development cartridge was used together with the previously described printer model LP9000C as a test driver. The test development cartridge and the test driver were modified so that the surface of the development roller is viewed. The sample development roller having the 3 μm thick nickel-phosphorus (Ni—P) electroless plated surface layer was produced. Another sample development roller was also produced by performing a 2-hour annealing process at 400° C.

Figure 9B:
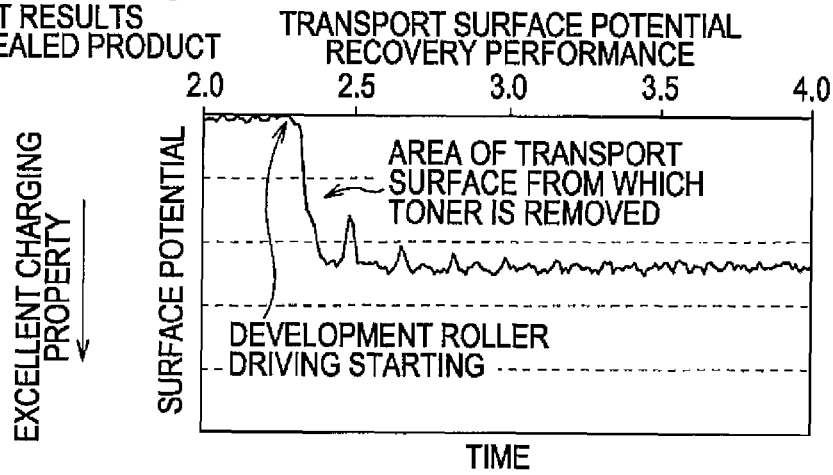
Figure 9C:
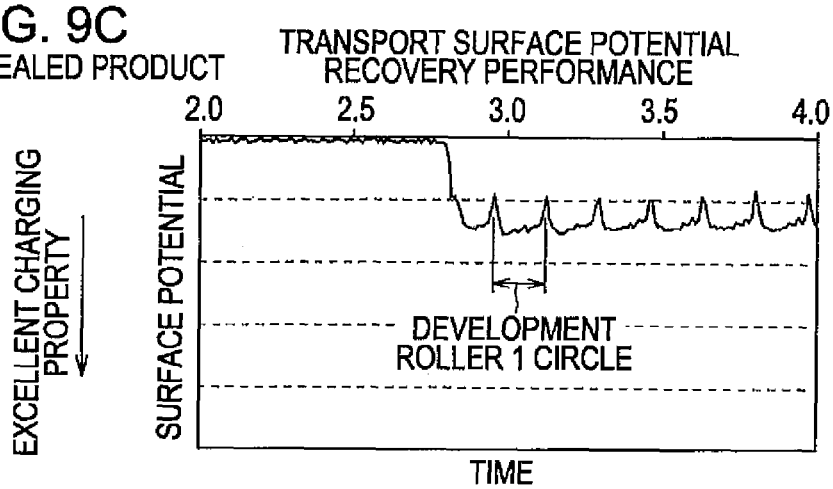

The first toner previously described was used here. The test driver with the test development cartridge mounted was operated in an idling mode. Part of the surface of the development roller was exposed by removing the toner on the circumference surface of the development roller. A surface potential meter was set on the development roller. A voltage difference between a toner removal portion and a toner non-removal portion on the development roller was measured with the development roller rotated. The recovery rate along the development roller was determined. FIGS. 9B and 9C illustrate the surface potential test results. FIGS. 9B and 9C illustrate that a peak indicating a low surface potential periodically appears from the start of driving of the development roller (DR). A portion corresponding to the low surface potential peak is where the toner is removed from a transport surface of the development roller. Generally, the development roller illustrated in FIG. 9B free from the annealing process is better in surface potential than the annealed development roller illustrated in FIG. 9C. More specifically, the annealing process degrades the surface potential recovery property of the toner transport surface of the development roller subsequent to toner image development.

The test results show that the surface of the top portion of the projection 30 crystallized through the annealing process increases the hardness thereof, and that the surface of the recess, not annealed, becomes amorphous, and provides a higher toner charging property.

In the development roller 25, the surface hardness of the high-hardness portion 30*a*" of the top portion 30*a* of the projection 30 in the development roller 25 is set to be higher than the surface hardness of the recess forming the first and second grooves 29*a* and 29*b* excluding the high-hardness portion 30*a*". In the long service life of image forming of the development roller 25, the wear of the surface layer 25*b* of the top portion 30*a*, typically likely to be worn, is not heavy. A wear difference between the projection and the recess is smaller than in the development roller in the related art. Even after the long service life of image forming, no large change results in the depth of the roughness portion of the development roller 25. The amount of toner transported to the development roller 25 does not change greatly. An image density level is thus maintained at a generally constant level. The development roller 25 can thus perform the development process for a long period of time.

Since the surface hardness of the recess of the development roller 25 is low, filming that is likely to take place in the recess typically having a slow refreshing property is prevented. Although the recess tends to lower the toner in toner charging property because of the distance from the toner regulator blade 26, the amorphous recess controls a decrease in toner charging property. By setting the toner charging property of the recess to be higher than the toner charging property of the projection, toner charging is effectively performed. Toner coverage and toner splashing are controlled, and excellent development characteristics are provided.

In a toner transport method in which toner is not transported to the surface of the projection 30 by the toner regulator blade 26, a function of the recess for maintaining the toner charging property at the surface of the recess is separated from a function of the projection for maintaining wear proofness on the surface of the projection (maintaining the depth of the roughness portion). The two functions are thus separately performed.

The top portion 30*a* of the projection 30, if crystallized, is lowered in toner charging property. A low toner charging property prevents chargeup from taking place between the toner regulator blade 26 and the projection 30 of the development roller, thereby improving development results. In a toner transport method, toner having a toner particle size smaller than a depth of the roughness portion of the development roller is transported to the recess of the development roller with a front edge of the toner regulator blade placed into contact with the development roller, and the toner is not transported to the projection. In such a toner transport method, the supply of the toner to the projection is more effectively controlled. Filming of the toner on a flat portion of the projection and chargeup of the toner are prevented.

The roughness portion of the surface layer 25*b* is constructed of the same material and the degree of crystallization is differentiated between the projection and the recess (for example, the projection is set to be higher in the degree of crystallization than the recess). With this arrangement, the surface hardness and electrical resistance of the projection and recess can be controlled. The surface layer 25*b* at the recess and the projection is not fully crystallized (whether the surface layer 25*b* is fully crystallized or not is determined through x-ray diffraction). The surface composition of the development roller is thus easily set up. Filming (fusion of toner) takes place if the wear of the projection is too small as a result of high hardness thereof. By controlling the degree of crystallization, the generation of filming is controlled.

By allowing the surface layer 25*b* at the projection 30 to be heated in a localized fashion, the base unit 25*a* is almost free from crystallization. The base unit 25*a* is thus free from release of stress, and bowing and bending responsive to variations in the degree of crystallization.

An area of the projection 30 where crystallization advances is limited to within the range of an average particle diameter (D50 particle diameter) of toner in use from the top surface of the projection 30. The toner particles transported to the recess that is subject to a decrease in charging property are thus allowed to be in contact with an amorphous recess. This arrangement prevents the toner from being lowered in the charging property.

Before forming the roughness portion on the base unit 25*a*, the surface layer 25*b* is formed on the base unit 25*a* through electroless plating. Even if a material relatively hard to machine is used for a base unit 25*a*, the configuration stability of the roughness portion is improved by the plated surface layer 25*b*. The roughness portion has an increased surface smoothness, allowing the toner particles to be moved smoothly. Filming of the toner at the recess is thus controlled. The toner transportability and the toner charging property are excellently maintained.

Figure 11A:
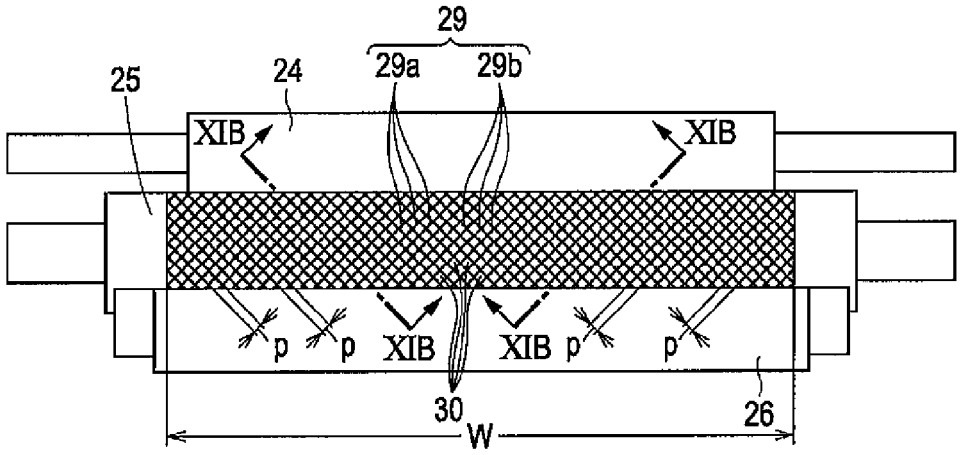
FIG. 11A diagrammatically illustrates a development roller, a toner feed roller, and a toner regulator unit.

Referring to FIG. 11A, a mesh-like roughness pattern is formed on the circumference surface of the development roller 25 as on the development roller 25 disclosed in Japanese Unexamined Patent Application Publication No. JP-A-2007-121948. This development roller 25 includes grooves 29 in a predetermined axial area on the circumference thereof as the roughness pattern. The grooves 29 include first grooves 29*a* of a predetermined number continuously spiraling at a predetermined angle with respect to the axial direction of the development roller 25 (the predetermined angle is 45° in FIG. 11A, but not limited to 45°), and second grooves 29*b* of a predetermined number continuously spiraling at an angle opposite to the slant angle of the first grooves 29*a*. The first and second grooves 29*a* and 29*b* are formed at the respective slant angles at a predetermined pitch p with regular interval of W along the axial direction of the development roller 25. The first and second grooves 29*a* and 29*b* may be different from each other in slant angle and pitch.

Figure 11B:
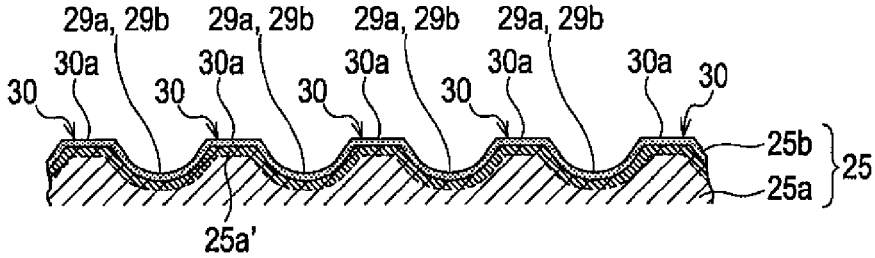
FIG. 11B is a partial sectional view illustrating part of the development roller and taken along line IIIB-IIIB in FIG. 11A.

With reference to FIG. 11B, the development roller 25 includes a base unit 25*a* made of a metal providing a relatively high hardness, and a single surface layer 25*b* formed on the circumference surface of the base unit 25*a*. The base unit 25*a* is a metal sleeve made of an aluminum based metal such as 5056 aluminum alloy or 6063 aluminum alloy, or an iron based metal such as STKM steel. The surface layer 25*b* is a nickel-based or chromium-based layer plated on the base unit 25*a*.

Figure 11C:
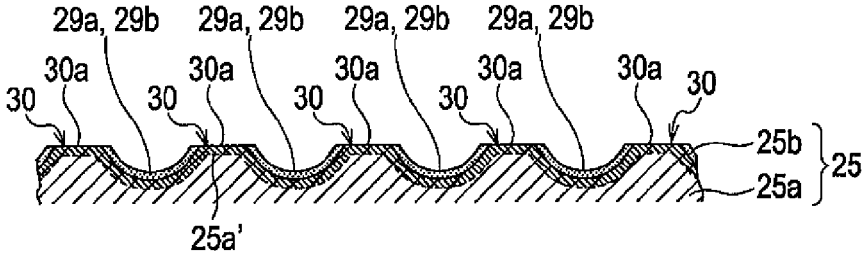
FIG. 11C is a partial sectional view illustrating part of the development roller with a surface layer thereof partially worn.
Figure 11D:
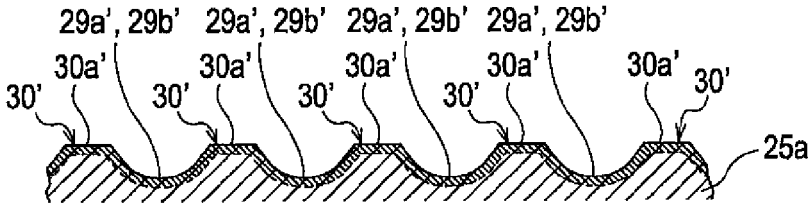
FIG. 11D is a partial sectional view of only the base unit of the development roller.

Referring to FIG. 11D, first and second grooves 29*a*' and 29*b*' for forming the first and second grooves 29*a* and 29*b* are formed on the circumference surface of the base unit 25*a* of the development roller 25 through component rolling. The machining method of forming the first and second grooves 29*a*' and 29*b*' may be any known method. The discussion of the machining method is thus omitted here. The base unit 25*a* has island projections 30' of a predetermined number surrounded by the first and second grooves 29*a*' and 29*b*'. In the specification, the base recess refers to a portion of the base unit 25*a* deeper than half the depth of each of the first and second base grooves 29*a*' and 29*b*' and the base projection 30' refers to a projection of the base unit 25*a* externally protruded from half the depth of each of the first and second base grooves 29*a*' and 29*b*'.

Figure 12A:
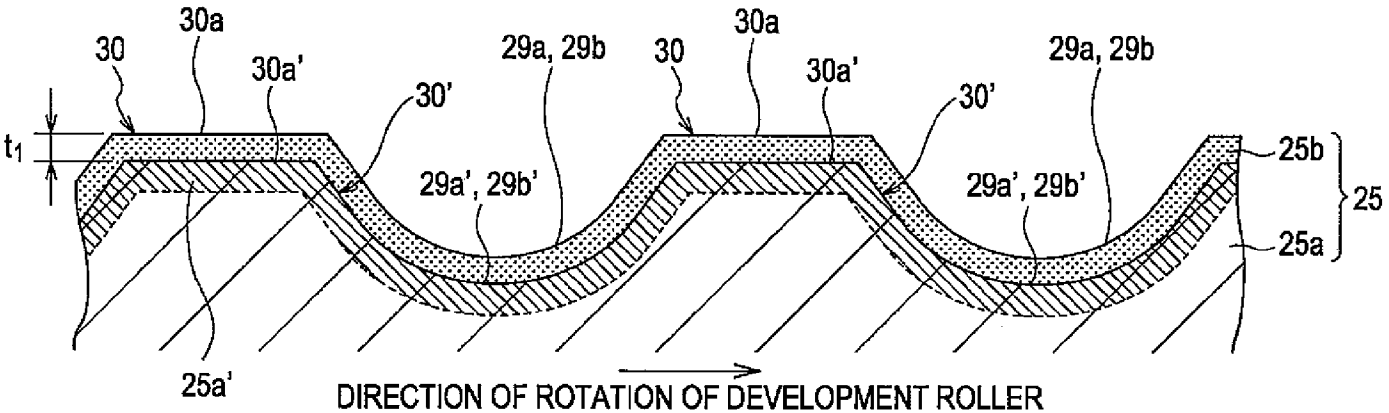
FIGS. 12A and 12B are partial sectional views of the development roller illustrated in FIG. 11B.

With reference to FIGS. 11D and 12A, the top of the base projection 30' is formed at the flat surface 30*a*'. The flat surface 30*a*' of each the projection 30' is square if the first and second grooves 29*a*' and 29*b*' have a slant angle of 45° and the same pitch p, and is diamond if the first and second grooves 29*a*' and 29*b*' have a slant angle of other than 45° and the same pitch p. The flat surface 30*a*' of each the projection 30' is rectangular if the first and second grooves 29*a*' and 29*b*' have a slant angle of 45° and different pitches p, and is parallelogrammic if the first and second grooves 29*a*' and 29*b*' have a slant angle of other than 45° and different pitches p. Regardless of the type of quadrilateral of the flat surface 30*a*', the flat surface 30*a*' of the projection 30' becomes a quadrangular pyramid frustum with four inclined walls.

Each of the first and second base grooves 29*a*' and 29*b*' has a curved recess surface in a sinusoidal wave configuration along an inclination direction. Each of the four side walls of the quadrangular pyramid frustum of the base projection 30' is continued to the curved recess surface in a sinusoidal wave configuration. The four side walls of the quadrangular pyramid frustum are respectively continued to the four side walls of the sinusoidal wave curved recesses at half the depth of the roughness portion.

With reference to FIGS. 11B and 11C, and 12A, the circumference surface of the base unit 25*a* has the grooves formed in component rolling. A high-hardness portion 25*a*' on the circumference surface is hardened through component rolling. The high-hardness portion 25*a*, is formed within a substantially constant thickness $t_1$ from the circumference of the base unit 25*a* and is higher in hardness than the remaining portion of the base unit 25*a*.

The circumference of the base unit 25*a* having the first and second grooves 29*a*' and 29*b*' and the base flat surface 30*a*' of the base projection 30' (i.e., the surface of the high-hardness portion 25*a*') is plated with an amorphous metal such as a nickel based electroless plate. The surface layer 25*b* is thus formed on the surface of the base unit 25*a*. The surface layer 25*b* is lower in surface hardness than the high-hardness portion 25*a*' of the base unit 25*a*. The thickness $t_1$ of the surface layer 25*b* is set to be within the range of the toner average particle diameter (D50 particle diameter) of the toner in use. The recesses of the first and second grooves 29*a* and 29*b* and the projection 30 are formed on the surface layer 25*b* similar in shape to the base recesses of the first and second base grooves 29*a*' and 29*b*' and the base projection 30'.

A quadrilateral flat top portion 30*a* is formed on the projection 30. With the surface layer 25*b* formed on the base unit 25*a*, the top portion 30*a* continued to the first and second grooves 29*a* and 29*b* has a quadrangular pyramid frustum with four inclined side walls. The four side walls of the quadrangular pyramid frustum are respectively continued to the four side walls of the first and second grooves 29*a* and 29*b* having a sinusoidal wave configuration.

The top portion g of the development roller a is relatively heavily worn in the flat configuration while the surface layer c of the recess formation portion f of the first and second grooves is not worn in practice as illustrated in FIG. 10B. The inventor of the invention has studied this phenomenon by conducting durability tests. The wear trace was measured using Keyence VK-9500 as a three-dimensional measuring laser microscope. The image forming apparatus used in the tests is printer model LP9000C manufactured by Seiko Epson. A development roller 25 to be discussed below was used instead of the original development roller in the printer model LP9000C. Printer model LP9000C was modified to employ the development roller 25. Image forming conditions in the durability tests were the standard image forming conditions of the printer model LP9000C.

Figure 13A:
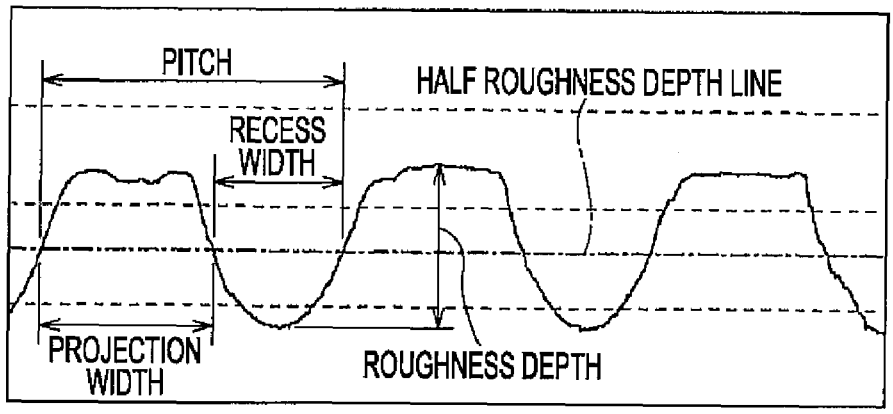
FIG. 13A illustrates a size of a roughness of the development roller.

Before forming the roughness portion on the base unit 25*a*, the base unit 25*a* of the development roller 25, made of STKM steel, was centerless machined in surface finishing. The first and second base grooves 29*a*' and 29*b*' were formed on the base unit 25*a* through component rolling. A nickel-phosphorus (Ni—P) layer is electroless plated to a thickness of 3 μm as the surface layer 25*b* on the base unit 25*a*. As illustrated in FIG. 13A, the development roller 25 was machined as below. In the development roller 25, the roughness depth (height from the bottom of the grooves 29*a* and 29*b* to the top surface of the projections 30) was 6 μm, the roughness pitch was 100 μm, the width of the projection 30 along a line extending at half the roughness depth was 60 μm, and the width of the recess along the half line was 40 μm.

The toner feed roller 24, made of urethane foam, was installed to press against the development roller 25 by an amount of sink of 1.5 mm. The toner regulator blade 26 was made of urethane rubber, and installed to be pressed against the development roller 25 under a pressure of 40 g/cm.

Two types of toner were used. A first type of toner was produced by manufacturing polyester particles through a pulverizing process, and by internally dispersing proper amounts of a charge control agent (CCA), a wax, and a pigment with the polyester particles into toner mother particles. Then externally added to the toner mother particles were small silica particles having a size of 20 nm, median silica particles having a size of 40 nm, large silica particles having a size of 100 nm, and titania particles having a size of 30 nm. The process resulted in small size toner having an average diameter D50 of 4.5 μm, and smaller than the roughness depth of 6 μm. A second type of toner was produced by manufacturing styrene acrylate particles through a polymerization process, and by internally dispersing proper amounts of a wax, and a pigment with the styrene acrylate particles into toner mother particles. Then externally added to the toner mother particles were small silica particles having a size of 20 nm, median silica particles having a size of 40 nm, large silica particles having a size of 100 nm, and titania particles having a size of 30 nm. The process resulted in small size toner having an average diameter D50 of 4.5 μm.

Figure 13B:
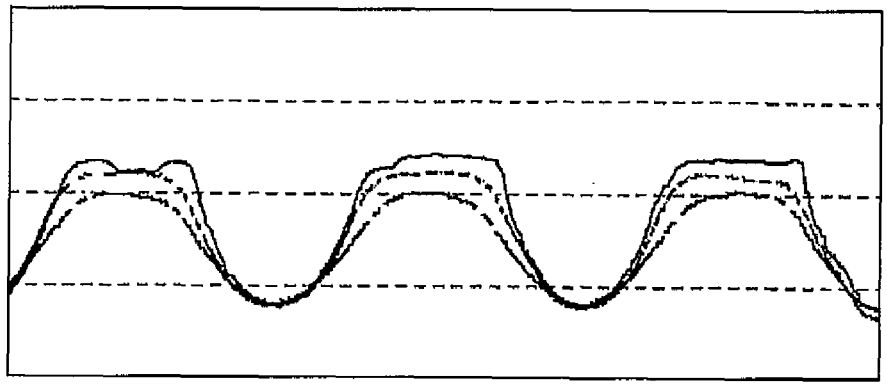
FIG. 13B illustrates a wear process of the development roller when a toner particle diameter is larger than a depth of the roughness of the development roller.

Durability image forming tests were conducted on A4 size standard sheets using a text pattern having a monochrome image occupancy rate of 5% under the standard image forming condition of the printer model LP9000C. When the first type small size toner was used, the top four side edges of the top portion 30*a* of the surface layer 25*b* at the projection 30 having an initial profile denoted by a solid line in FIG. 13B tended to be worn into a curved profile denoted by a dot-and-dash chain line as the number of image forming cycles increased. When the second type small size toner was tested, the projections 30 tended to be worn into the curved profile similar to that when the first type toner was used.

The possible reason why such a curved wear profile occurred is described below. As the development roller 25 rotates in FIG. 6A, the toner feed roller 24 and the toner regulator member 26 are respectively pressed against the development roller 25. Toner particles present on the flat surfaces 30*a* of the projections 30 move into the first and second grooves 29*a* and 29*b*. Since the average diameter (D50 particle diameter) of the toner particles is smaller than the roughness depth, almost all the toner particles of the toner 28 having moved into the first and second grooves 29*a* and 29*b* are arranged in a plurality of layers. As the development roller 25 further rotates, toner particles present in the first and second grooves 29*a* and 29*b* move onto the flat surfaces 30*a* of the projections 30. Since the top layer of toner particles is then about at the same level as the flat surface 30*a* of the projection 30, mainly the toner particles at the top layer out of the toner particles in the first and second grooves 29*a* and 29*b* horizontally move, and most of the remaining toner particles at the lower layers remain stationary. In the course of the movement of the top layer toner particles, the external additive having a relatively high hardness coating the toner mother particles gradually wears the surface of the surface layer 25*b* into a substantially flat state for a long period of time.

As FIG. 11B, FIGS. 6A and 6B are sectional views of the first and second grooves 29*a* and 29*b* taken along a line perpendicular to the running direction (slant angle) of the grooves. The partial sectional views of the development roller 25 are not aligned with the direction of rotation of the development roller 25. Toner particles on the first grooves 29*a* thus move onto the flat surfaces 30*a* of the projections 30, and then move to any of the first and second grooves 29*a* and 29*b* adjacent to the projections 30. Furthermore, toner particles on the second grooves 29*b* move onto the flat surfaces 30*a* of the projections 30, and then move to any of the first and second grooves 29*a* and 29*b* adjacent to the projections 30. The toner movement is identical to the other examples of the development roller 25.

Figure 12B:
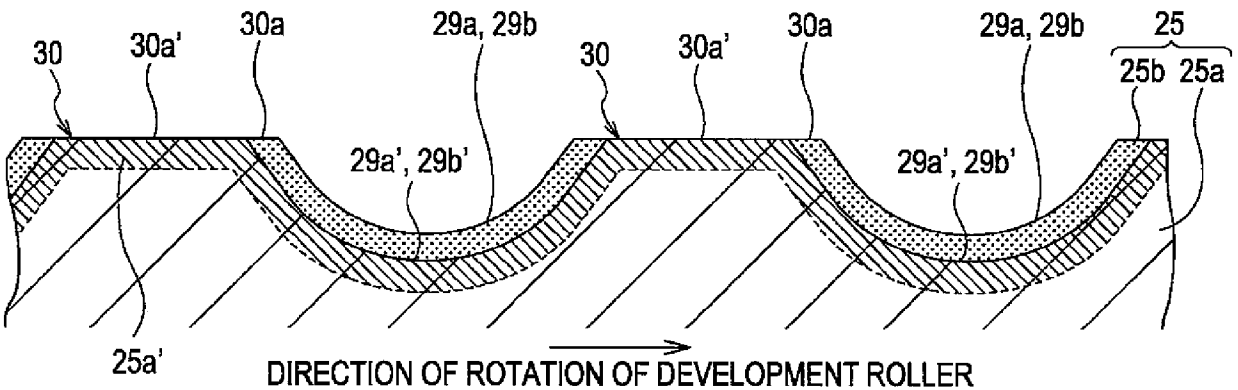

The development roller 25 is used with the surface layer 25*b* formed on the base flat surface 30*a*' of the base projection 30' as illustrated in FIG. 12. As the development roller 25 is used in image forming for a long period of time, the surface layer 25*b* on the base flat surface 30*a*' is worn, and the base flat surface 30*a*' of the base projection 30' is then exposed as illustrated in FIGS. 11C and 12B. The base flat surface 30*a*' is set to be higher in surface hardness than surface layer 25*b* at the first and second grooves 29*a* and 29*b* (i.e., the recess of the surface layer 25*b*) through work hardening. If the base flat surface 30*a*' of the base projection 30' is exposed, the wear rate of the projection 30 of the development roller 25 against the toner regulator blade 26, the toner feed roller, the toner external additive, etc. is decreased. The durability of the development roller 25 is increased. If the surface layer 25*b* at the base flat surface 30*a*' is eliminated, the depth of the roughness portion of the development roller 25 changes slightly. However, since the wearing of the exposed base flat surface 30*a*' is controlled, the wear rate of the projection 30 is reduced. As a result, a change in the depth of the roughness portion of the development roller 25 is controlled for a long period of time.

One method of manufacturing the development roller 25 is described below.

Figure 14A:
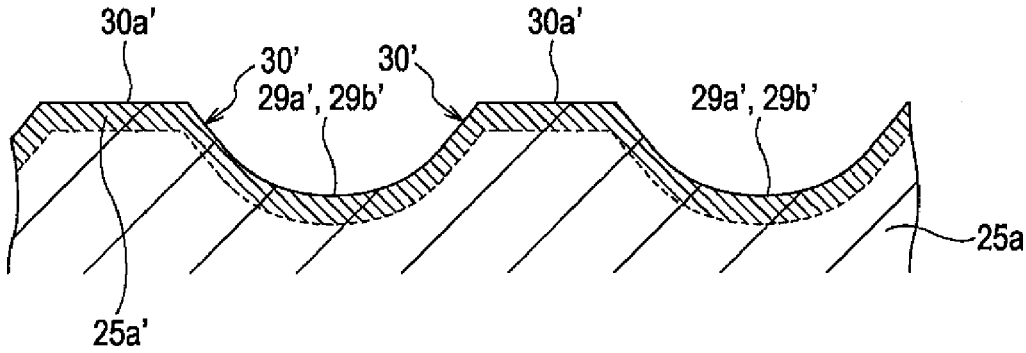
FIGS. 14A-14C illustrate a method of manufacturing the development roller illustrated in FIGS. 11A-11D and 12A and 12B.
Figure 14B:
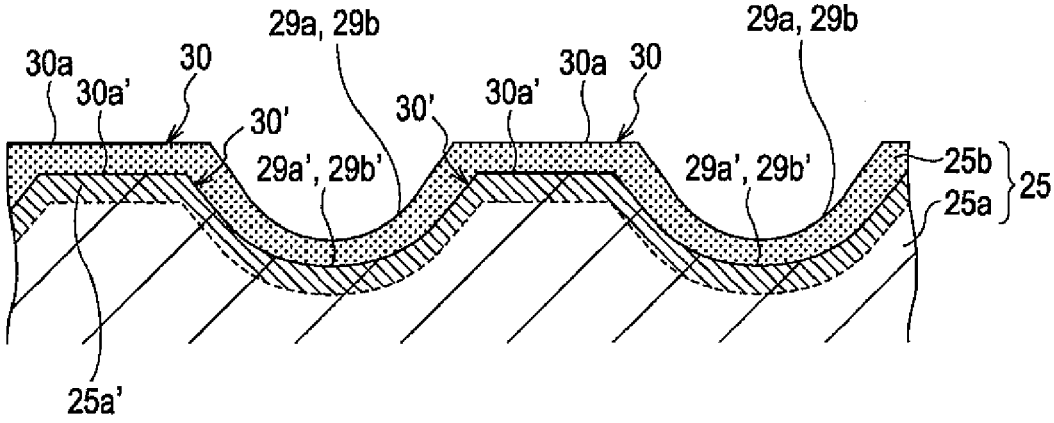

Referring to FIG. 14A, the base unit 25*a* is component rolled to form the first and second base grooves 29*a*' and 29*b*'. The high-hardness portion 25*a*' is formed on the circumference of the base unit 25*a* through work hardening in the groove formation. Referring to FIG. 14B, an amorphous surface layer 25*b* is formed through electroless plating on the surface of the base unit 25*a*. The first and second grooves 29*a* and 29*b* are formed in accordance with the first and second grooves 29*a*' and 29*b*'. The projection 30 refers to the top portion 30*a* externally protruded from half the depth of each of the first and second grooves 29*a* and 29*b* and the recess refers to a portion of the base unit 25*a* (opposite to the top portion 30*a*) deeper than half the depth of each of the first and second grooves 29*a* and 29*b*. The high-hardness portion 25*a*' of the base unit 25*a* is set to be higher in surface hardness than the surface layer 25*b*. The surface hardness of the high-hardness portion 25*a*' of the base unit 25*a* is set to be higher than the surface hardness of the surface layer 25*b*. The development roller 25 of FIG. 14A having the surface layer 25*b* at the base flat surface 30*a*' of the base projection 30' thus results. As the surface layer 25*b* at the base flat surface 30*a*, of the base projection 30' is worn and exposed in the course of long service life of the development roller 25, the base flat surface 30*a*' of the base projection 30' is also exposed as illustrated in FIG. 12B.

The formation of the surface layer 25*b* on the base flat surface 30*a*' of the development roller 25 illustrated in FIG. 12A is optional. The development roller 25 may be used with the surface layer 25*b* of FIG. 12A removed from the base projection 30' and the base flat surface 30*a*' exposed as illustrated in FIG. 12B. The surface layer 25*b* on the base flat surface 30*a*' may be removed through one of a known grinding process using a grinding machine and a known polishing process using a polishing machine.

The development roller 25 of one embodiment of the invention is specifically described below.

Before forming the roughness portion on the base unit 25*a*, the base unit 25*a* of the development roller 25, made of steel use stainless (SUS) steel having an Hv (Vickers hardness) of 250, was centerless machined in surface finishing. A base roughness portion having a depth of 8 μm was formed on the surface of the base unit 25*a* through component rolling. The base recesses 29*a*' and 29*b*' (the bottoms of the recesses of the projections 30') were formed in a sinusoidal wave configuration. The base flat surface 30*a*' of the base projection 30' was formed in a quadrangular pyramid frustum. The four inclined walls of the quadrangular pyramid frustum are respectively formed in continuation with the four walls of the sinusoidal wave recesses 29*a*' and 29*b*'. Points where the four side walls of the quadrangular pyramid frustum of the base projection 30' meet the four side walls of the sinusoidal wave curved recesses of the first and second grooves 29*a*' and 29*b*' are at half the depth of the base roughness portion. Since the SUS steel as a material of the base unit 25*a* had a relatively large degree of work hardening, the surface hardness of the base unit 25*a* subsequent to component rolling was an Hv of 700.

A nickel-phosphorus (Ni—P) layer was electroless plated to a thickness $t_1$ of about 1.5 μm as the surface layer 25*b* on the base unit 25*a*. The surface hardness of the surface layer 25*b* was an Hv of 500. The development roller 25 was thus obtained.

Durability tests similar to those described were conducted on the development roller 25. The flat surface 30*a*' made of the SUS steel was exposed as illustrated in FIG. 7C, and it was verified that the wearing thereafter was controlled.

Figure 15A:
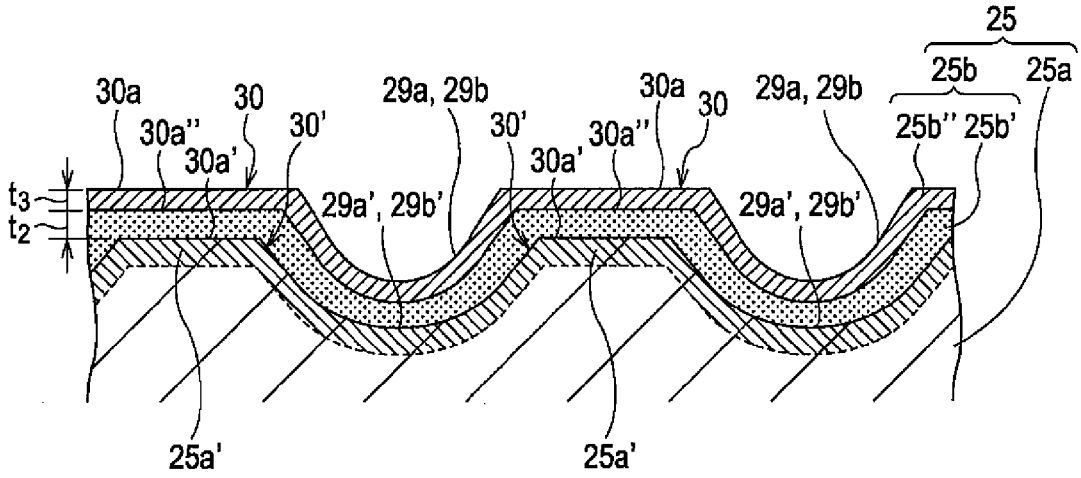
FIGS. 15A-15B illustrate another method of manufacturing the development roller illustrated in FIGS. 11A-11D and 12A and 12B.
Figure 15B:
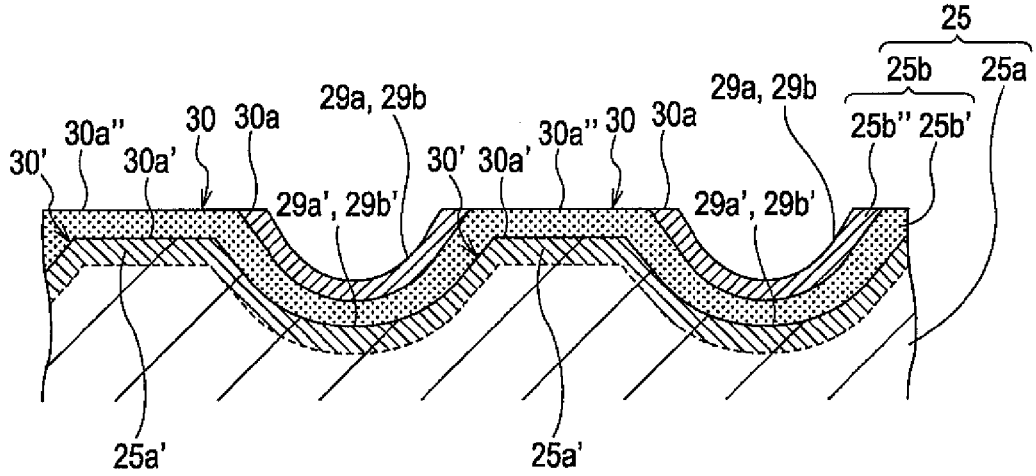

FIGS. 15A and 15B, respectively similar to partially expanded sectional views of FIGS. 12A and 12B, illustrate a development roller 25 in accordance with another embodiment of the invention.

In the preceding example of the development roller 25 of FIGS. 12A and 12B, the surface layer 25*b* is a single layer. Referring to FIG. 15A, the development roller 25 includes a first surface layer 25*b*' and a second surface layer 25*b*". The first surface layer 25*b*' is formed on the circumference of the base unit 25*a* and the second surface layer 25*b*" is formed on the circumference of the first surface layer 25*b*'. A thickness of $t_2$ of the first surface layer 25*b*' is set to be larger than a thickness of $t_3$ of the second surface layer 25*b*". In this case, the thickness $t_3$ of the second surface layer 25*b*" is set to be within the range of the toner average particle diameter (D50 particle diameter) of the toner in use. The surface hardness of the first surface layer 25*b*' immediately inside the second surface layer 25*b*" as the outermost layer is set to be higher than the surface hardness of the second surface layer 25*b*". The toner charging property of the second surface layer 25*b*" is set to be higher than the toner charging property of the first surface layer 25*b*' immediately inside the second surface layer 25*b*".

It is not necessary that the base unit 25*a* of the development roller 25 be made of a metal having high hardness as a result of work hardening. Alternatively, as previously discussed, the base unit 25*a* may be made of a metal having high hardness.

The rest of the structure of the development roller 25 remains unchanged from the one previously discussed. The development roller 25 may be used in the development device 5' and the image forming apparatus 1.

The development roller 25 is used with the second surface layer 25*b*" formed at the base flat surface 30*a*' of the base projection 30' as illustrated in FIG. 15A. As the development roller 25 is used in image forming for a long period of time, the second surface layer 25*b*" on the base flat surface 30*a*' is worn, and the flat surface 30*a*" of the first surface layer 25*b*' at the base flat surface 30*a*' is then exposed as illustrated in FIG.

15B. The first surface layer 25*b*' is higher in surface hardness than the second surface layer 25*b*" at the first and second grooves 29*a* and 29*b* (i.e., the recess of the development roller 25). If the flat surface 30*a*" of the first surface layer 25*b*' at the base flat surface 30*a*' is exposed, the wear rate of the projection 30 of the development roller 25 against the toner regulator blade 26, the toner feed roller, the toner external additive, etc. is decreased. The durability of the development roller 25 is increased. If the second surface layer 25*b*" at the base flat surface 30*a*' is eliminated, the depth of the roughness portion of the development roller 25 changes slightly. However, since the wearing of the exposed the first surface layer 25*b*' is controlled, the wear rate of the projection 30 is reduced. As a result, a change in the depth of the roughness portion of the development roller 25 is controlled for a long period of time. The surface layer 25*b* is not limited to two layers, but may include three or more layers. In such a case, the surface hardness of a layer immediately inside the outermost layer of the surface layer 25*b* is set to be higher in surface hardness than the outermost layer.

In the manufacture of the development roller 25 having the above-described structure, an amorphous metal is electroless plated as the first surface layer 25*b*' on the circumference of the base unit 25*a* having the roughness portion. The first surface layer 25*b*' is annealed in a heat treatment process for crystallization. The hardness of the first surface layer 25*b*' is thus increased. Crystallization is analyzed through x-ray diffraction. An amorphous metal or a crystallized metal is electroless plated on the circumference of the first surface layer 25*b*' as the second surface layer 25*b*". If an amorphous metal is used for the second surface layer 25*b*", the second surface layer 25*b*" is set to be more amorphous than the first surface layer 25*b*' by varying the temperature of a plating bath and the composition of metals contained in the plating bath. The rest of the manufacturing method is substantially identical to the manufacturing method of the development roller 25 illustrated in FIGS. 14A-14C. This the development roller 25 is also used with the second surface layer 25*b*" formed on the base flat surface 30*a*'. When the second surface layer 25*b*" at the base flat surface 30*a*' of the base projection 30' is worn and eliminated in the long service life of the development roller 25, the base flat surface 30*a*' of the base projection 30' is exposed as illustrated in FIG. 15B.

It is not necessary that the second surface layer 25*b*" be formed on the base flat surface 30*a*' of the base projection 30' as illustrated in FIG. 15A. More specifically, the development roller 25 may be used with the second surface layer 25*b*" illustrated in FIG. 15A on the base flat surface 30*a*' removed and with the first surface layer 25*b*' illustrated in FIG. 15B on the base flat surface 30*a*, exposed. The second surface layer 25*b*" may be removed through one of a known grinding process using a grinding machine and a known polishing process using a polishing machine.

The development roller 25 of one embodiment of the invention is specifically described below.

Before forming the roughness portion on the base unit 25*a*, the base unit 25*a* of the development roller 25, made of STKM steel having an Hv (Vickers hardness) of 150, was centerless machined in surface finishing. A base roughness portion having a depth of 8 μm was formed on the surface of the base unit 25*a* through component rolling. The base recesses 29*a*' and 29*b*' (the bottoms of the recesses of the projections 30') were formed in the same manner as previously discussed.

An amorphous nickel-phosphorus (Ni—P) layer was electroless plated to a thickness $t_2$ of 3 μm as the first surface layer 25*b*'. The first surface layer 25*b*' was annealed at 400° C. for crystallization. The surface hardness of the first surface layer 25*b*' was an Hv of 1000. An amorphous nickel-phosphorus (Ni—P) layer was electroless plated to a thickness $t_3$ of 1.5 μm as the second surface layer 25*b*" on the first surface layer 25*b*'. The surface hardness of the second surface layer 25*b*" was an Hv of 500. The development roller 25 was thus obtained.

Figure 14C:
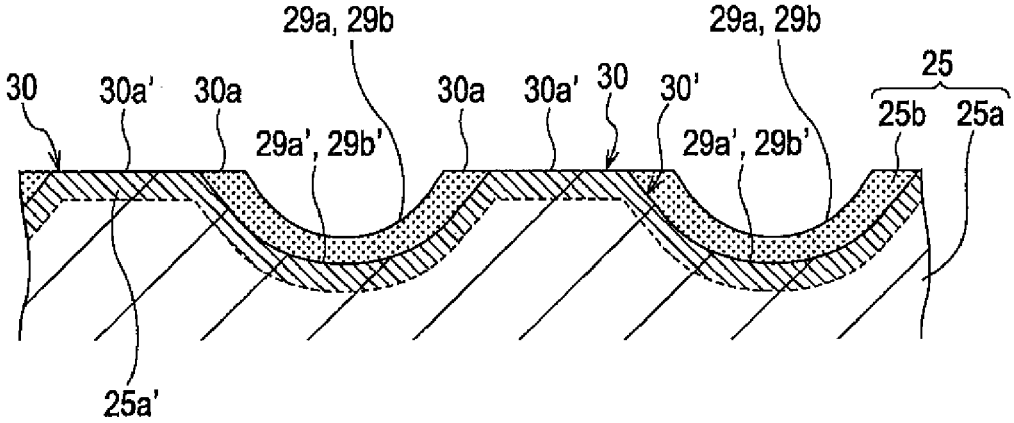

Durability tests similar to those previously described were conducted on the development roller 25. The flat surface 30*a*' made of the SUS steel was exposed as illustrated in FIG. 14C, and it was verified that the wearing thereafter was controlled.

Tests were conducted on the toner charging property and the surface potential of the development roller of one embodiment of the invention. The tests included a toner rubbing test to measure a toner charge amount and a surface potential test on a toner transport surface of the development roller.

A nickel-phosphorus (Ni—P) layer as a sample plate was electroless plated to a thickness of 3 μm on an STKM development roller. Surface hardness of the sample plate was an Hv of 550. Another sample plate having the same specification was produced, and then the sample plate was annealed at 400° C. for two hours to crystallize the surface thereof. Surface hardness of the sample plate was an Hv of 1000. It was learned that the annealing process increased the hardness of the surface layer of the sample plate.

The first type of toner previously discussed was used here. A blade was produced of the same urethane rubber as the one used for the toner regulator blade 26. The toner was then dispersed on each sample plate, and the urethane rubber blade was rubbed on the toner on each sample plate. An amount of charge of rubbed toner was measured using an electric charge measuring instrument. The rubbing operation was repeated. Each time a predetermined number of rubbing operations was completed, the amount of toner charge was measured. FIG. 9A illustrates the toner rubbing test results. As illustrated in FIG. 9A, the sample plate with the plated layer not annealed provided a higher toner charging property.

In the surface potential test of the toner transport surface of the development roller, a test development cartridge was used together with the previously described printer model LP9000C as a testing device. The test development cartridge and the test device were modified so that the surface of the development roller is viewed. The sample development roller having the 3 μm thick nickel-phosphorus (Ni—P) electroless plated surface layer was produced. Another sample development roller was also produced by performing a 2-hour annealing process at 400° C. in the same manner as previously described.

The first type of toner previously discussed was used here. The testing device with the test development cartridge mounted was operated in an idling mode. Part of the surface of the development roller was exposed by removing the toner on the circumference surface of the development roller. A surface potential meter was set on the development roller. A voltage difference between a toner removal portion and a toner non-removal portion on the development roller was measured with the development roller rotated. The recovery rate of the development roller was determined. FIGS. 9B and 9C illustrate the surface potential test results. FIGS. 9B and 9C illustrate that a peak indicating a low surface potential periodically appears from the start of driving of the development roller (DR). A portion corresponding to the low surface potential peak is where the toner is removed from a transport surface of the development roller. Generally, the development roller illustrated in FIG. 9B free from the annealing process is better in surface potential than the annealed development roller illustrated in FIG. 9C. More specifically, the annealing process degrades the surface potential recovery property of the toner transport surface of the development roller subsequent to toner image development.

The test results show that the surface of the top portion of the projection 30 crystallized through the annealing process increases the hardness thereof, and that the surface of the recess, not annealed, becomes amorphous, and provides a higher toner charging property.

If a single surface layer 25*b* is formed on the base unit 25*a* of the development roller 25, the surface hardness of the base unit 25*a* is set to be higher than the surface hardness of the surface layer 25*b* as the outermost layer. If a plurality of surface layers 25*b* are formed on the base unit 25*a*, the surface hardness of the first surface layer 25*b*' immediately inside the second surface layer 25*b*" is set to be higher than the surface hardness of the second surface layer 25*b*". In the service life of image forming of the development roller 25, one of the first surface layer 25*b*' at the base flat surface 30*a*' of the base projection 30' and the second surface layer 25*b*" at the base flat surface 30*a*' is worn by the toner regulator blade 26, the toner feed roller, the toner external additive, etc. When one of the base flat surface 30*a*' and the first surface layer 25*b*' is exposed, the wear rate of the projection 30 of the development roller 25 is decreased. The durability of the development roller 25 is thus increased.

If one of the surface layer 25*b* and the second surface layer 25*b*" at the base flat surface 30*a*' is eliminated, the depth of the roughness portion of the development roller 25 changes slightly. However, the wearing of one of the exposed base flat surface 30*a*' and the exposed first surface layer 25*b*' is controlled. As a result, a change in the depth of the roughness portion of the development roller 25 is controlled for a long period of time. The amount of toner transported to the development roller 25 does not change greatly. An image density level is thus maintained at a generally constant level. The development roller 25 can thus perform the development process for a long period of time.

Although the toner charging property is lowered by one of the exposed top portion 30*a* and the exposed first surface layer 25*b*' at the projection 30, toner particles pinched between the development roller 25 and the toner regulator blade 26 result in stronger frictional force than that at the recess. A decrease in the toner charging property is controlled accordingly. Toner coverage and toner splashing are controlled, and excellent development characteristics are provided.

In a toner transport method in which toner is not transported to the surface of the projection 30 with a toner regulator blade 26, a function of the recess for maintaining the toner charging property at the surface of the recess is separated from a function of the projection for maintaining wear proofness on the surface of the projection (maintaining the depth of the roughness portion). The two functions are thus separately performed.

The thickness of one of the surface layer 25*b* and the second surface layer 25*b*" is set to be within the range of an average particle diameter (D50 particle diameter) of the toner in use. The toner transported to the recess subject to a decrease in the charging property is placed into contact with the amorphous recess. A decrease in the toner charging property is thus controlled.

One of the surface layer 25*b* and the second surface layer 25*b*" may be removed through a grinding process of a grinding machine or a polishing process of a polishing machine. If the development roller 25 having the exposed the base flat surface 30*a*' of the base projection 30' of the base unit 25*a* or the exposed first surface layer 25*b*' at the base flat surface 30*a*' is used from the start, the same operation and advantages previously described may be provided.

The development device 51 containing the development roller 25 can develop toner images on the latent image bearing unit in accordance with the electrostatic latent images for a long period of time. The image forming apparatus 1 containing the development device 5' can provide stable and excellent-quality images for a long period of time.

The number and pitch of the second grooves 29*b* may or may not be identical to the number and pitch of the first grooves 29*a*. The number of first grooves 29*a* may be 1 or more, and the number of second grooves 29*b* may be 1 or more.

The toner particles are coated with silica having a relatively high hardness as an external additive with the silica coverage ratio to the toner mother particles being 100% or more. Silica is abundant in the surface of the toner mother particles. This causes a relatively high wear rate in the surface layer 25*b* of the projection 30. Even if the development roller 25 is used in the development device 5' that uses the toner having a silica coverage rate of 100% or more, the durability of the development roller 25 is still effectively increased.

The base recesses of the first and second grooves 29*a*' and 29*b*' are not limited to the sinusoidal wave configuration. The base recesses may be curved or may be an inverted quadrangular pyramid frustum with a flat top surface. In such a case, the inverted quadrangular pyramid frustum may be continued to a quadrangular pyramid frustum of the base projection at inflection points thereof (at positions about half the depth of the base roughness).

In the above-described embodiments, the invention is applied to the image forming apparatus 1 containing the rotary development unit 5. The invention is not limited to the image forming apparatus 1. The invention is applicable to image forming apparatuses including a development device with the development roller having at least a roughness portion. Such image forming apparatuses include an image forming apparatus having an image forming units arranged in tandem, a four-cycle image forming apparatus, a monochrome image forming apparatus, and an image forming apparatus that directly transfers a toner image to a transfer material (transfer medium of one embodiment of the invention) from an image bearing unit (i.e., an image forming apparatus having no intermediate transfer medium). The invention is applicable to any image forming apparatus falling within the scope defined by the claims.

What is claimed is:

1. A development roller, comprising a base unit having a base recess and a base projection that are formed in a predetermined area of a circumference surface of the base unit, and a surface layer formed on the circumference surface of the base unit and having on the circumference thereof a recess and a projection formed respectively in accordance with the base recess and the base projection of the base unit, wherein surface hardness of the projection is higher than surface hardness of the recess.

2. The development roller according to claim 1, wherein a charging property of toner at the recess is higher than a charging property of toner at the projection.

3. The development roller according to claim 1, wherein the surface layer at the projection is higher in the degree of crystallization than the surface layer at the recess.

4. The development roller according to claim 1, wherein each of the surface layer at the recess and the surface layer at the projection is not fully crystallized.

5. A development device, comprising a development roller that transports toner to a latent image bearing unit, a toner feed roller that remains in contact with the development roller to feed the toner, and a toner regulator unit that remains in contact with the development roller and regulates an amount of toner to be fed to the latent image bearing unit, wherein the development roller is the development roller according to claim 1, and wherein an average diameter of particles of the toner is smaller than the depth of the recess of the development roller.

6. The development device according to claim 5, wherein the toner regulator unit includes a blade made of an elastic material, a front edge of the blade being in contact with the development roller or being present within a regulating nip to the development roller.

7. An image forming apparatus, comprising a latent image bearing unit on which at least an electrostatic latent image is formed, a development device that develops on the latent image bearing unit a toner image with toner in a noncontact development fashion in accordance with the electrostatic latent image, and a transfer device that transfers the toner image from the latent image bearing unit to a transfer medium, wherein the development device is the development device according to claim 6.

8. The development roller according to claim 1, wherein the surface layer comprises at least one layer, wherein surface hardness of the base projection is higher than surface hardness of the projection of the surface layer if the surface layer includes one layer only, and wherein surface hardness of a layer immediately inside the outermost layer is higher than surface hardness of the outmost layer if the surface layer includes a plurality of layers.

9. The development roller according to claim 8, wherein thickness of the surface layer is smaller than an average diameter of toner particles of toner used if the surface layer includes one layer only, and wherein thickness of the outermost layer is smaller than the average diameter of toner particles of the toner used if the surface layer includes a plurality of layers.

10. A development device, comprising a development roller that transports toner to a latent image bearing unit, a toner feed roller that remains in contact with the development roller to feed the toner, and a toner regulator unit that remains in contact with the development roller and regulates an amount of toner to be fed to the latent image bearing unit, wherein the development roller is the development roller according to claim 8, and wherein an average diameter of particles of the toner is smaller than a depth of the recess of the development roller.

11. The development device according to claim 10, wherein the toner regulator unit includes a blade made of an elastic material, a front edge of the blade being in contact with the development roller or being present within a regulating nip to the development roller.

12. An image forming apparatus, comprising a latent image bearing unit on which at least an electrostatic latent image is formed, a development device that develops on the latent image bearing unit a toner image with toner in a non-contact development fashion in accordance with the electrostatic latent image, and a transfer device that transfers the toner image from the latent image bearing unit to a transfer medium, wherein the development device is the development device according to claim 10.

13. The development roller according to claim 1, wherein the surface layer comprises at least one layer, wherein a top portion of the base projection is exposed if the surface layer includes one layer only, and wherein a layer immediately inside the outermost layer is exposed at the top portion of the base projection if the surface layer includes a plurality of layers.

14. The development roller according to claim 1, wherein the surface layer is manufactured through electroless plating.

15. A method of manufacturing a development roller, comprising forming a base recess and a base projection on at least an entire image forming area of a base unit, covering at least the entire image forming area with an amorphous metal subsequent to the formation of the base recess and base projection, and crystallizing the amorphous metal covering the base projection.

16. The method according to claim 15, wherein the base recess and the base projection are formed through component rolling.

17. A method of manufacturing a development roller, comprising forming a base recess and a base projection by component rolling on at least an entire image forming area of a base unit, and covering at least the entire image forming area with at least one or more layers of an amorphous metal subsequent to the formation of the base recess and base projection.

18. The method according claim 17, wherein if the amorphous metal includes a plurality of layers, a layer immediately inside an outermost layer has a hardness higher than a hardness of the outermost layer and a toner charging property lower than a toner charging property of the outermost layer.

19. The method according to claim 17, wherein if the amorphous metal includes a plurality of layers, the method further comprises heating a layer immediately inside an outermost layer for crystallization, and covering with the outermost layer the surface of the layer immediately inside the outermost layer, the crystallization of which has advanced as a result of heating.

20. The method according to claim 17, further comprising removing an outermost layer.

* * * * *